US011725496B2

(12) United States Patent
Ng et al.

(10) Patent No.: US 11,725,496 B2
(45) **Date of Patent: *Aug. 15, 2023**

(54) METHODS AND SYSTEMS FOR PERFORMING AUTOMATED DRILLING OF A WELLBORE

(71) Applicant: Pason Systems Corp., Calgary (CA)

(72) Inventors: Choon-Sun James Ng, Calgary (CA); Daniel John Paslawski, Calgary (CA); Aaron Eddy, Calgary (CA)

(73) Assignee: PASON SYSTEMS CORP.

( * ) Notice: Subject to any disclaimer, the term of this patent is extended or adjusted under 35 U.S.C. 154(b) by 1096 days.

This patent is subject to a terminal disclaimer.

(21) Appl. No.: 16/206,125

(22) Filed: Nov. 30, 2018

(65) Prior Publication Data

US 2020/0056470 A1 Feb. 20, 2020

(30) Foreign Application Priority Data

Aug. 17, 2018 (CA) ..... CA 3014816

(51) Int. Cl.
*E21B 44/04* (2006.01)
*E21B 19/06* (2006.01)
(Continued)

(52) U.S. Cl.
CPC ..... *E21B 44/04* (2013.01); *E21B 3/022* (2020.05); *E21B 19/06* (2013.01); *E21B 45/00* (2013.01); *E21B 49/00* (2013.01)

(58) Field of Classification Search
CPC ..... E21B 44/04; E21B 44/02; E21B 44/06; E21B 44/00; E21B 3/02; E21B 19/06; E21B 21/08; E21B 45/00; E21B 49/00
See application file for complete search history.

(56) References Cited

U.S. PATENT DOCUMENTS 6,480,118 B1 * 11/2002 Rao ..... E21B 49/00 73/152.16
9,388,681 B2 7/2016 Dykstra et al.
(Continued)

FOREIGN PATENT DOCUMENTS

CA 2557189 A1 9/2005
CA 2857707 A1 * 6/2013 ..... E21B 10/00
(Continued)

OTHER PUBLICATIONS

J Hood and et al, "Real-Time BHA Bending Information Reduces Risk when Drilling Hard Interbedded Formations", the SPE/IADC Drilling Conference held in Amsterdam, The Netherlands, Feb. 19-21, 2003 (Year: 2003).*
(Continued)

*Primary Examiner* — Douglas Kay
(74) *Attorney, Agent, or Firm* — Katten Muchin Rosenman LLP

(57) ABSTRACT

There are described methods, systems, and techniques for performing automated drilling of a well bore. The well bore is drilled according to one or more drilling parameter targets associated with one or more corresponding drilling parameters. A controlling drilling parameter of the one or more drilling parameters is determined to be outside a threshold window. In response to determining that a stringer has been encountered, one or more controlled drilling parameter targets of the one or more drilling parameter targets are updated. The controlled drilling parameter targets comprise a revolutions per minute (RPM) target and weight-on-bit (WOB) target.

21 Claims, 21 Drawing Sheets

(51) Int. Cl.

| | |
|---|---|
| ***E21B 45/00*** | (2006.01) |
| ***E21B 49/00*** | (2006.01) |
| ***E21B 3/02*** | (2006.01) |

(56) References Cited

U.S. PATENT DOCUMENTS

| | | | | |
|---|---|---|---|---|
| 9,436,173 | B2 | 9/2016 | Wang et al. | |
| 9,482,084 | B2 | 11/2016 | Chang et al. | |
| 10,202,837 | B2 * | 2/2019 | Ng | E21B 45/00 |
| 10,767,462 | B2 * | 9/2020 | Ng | E21B 44/02 |
| 2004/0256152 | A1 * | 12/2004 | Dashevskiy | E21B 44/00 175/25 |
| 2005/0211468 | A1 * | 9/2005 | Veeningen | E21B 7/04 175/24 |
| 2012/0118637 | A1 | 5/2012 | Wang | |
| 2012/0123756 | A1 * | 5/2012 | Wang | E21B 44/00 703/2 |
| 2014/0277752 | A1 | 9/2014 | Chang | |
| 2015/0083493 | A1 * | 3/2015 | Wassell | E21B 44/00 702/9 |
| 2015/0240615 | A1 | 8/2015 | Dykstra | |
| 2016/0168973 | A1 | 6/2016 | Dykstra et al. | |
| 2017/0002641 | A1 | 1/2017 | Dykstra et al. | |
| 2017/0328193 | A1 * | 11/2017 | Holt | E21B 12/02 |
| 2018/0328160 | A1 * | 11/2018 | Belaskie | E21B 45/00 |
| 2020/0173269 | A1 * | 6/2020 | Madasu | E21B 7/06 |
| 2020/0302353 | A1 * | 9/2020 | Tang | G06Q 50/02 |
| 2021/0195091 | A1 * | 6/2021 | Gong | H04N 5/23287 |

FOREIGN PATENT DOCUMENTS

| | | | | | |
|---|---|---|---|---|---|
| CA | 2899975 | A1 | * | 10/2014 | E21B 44/00 |
| CA | 2987662 | | | 2/2018 | |
| CN | 101868595 | A | * | 10/2010 | E21B 44/00 |
| CN | 105041210 | B | * | 3/2017 | |
| JP | H06242833 | A | * | 9/1994 | |
| WO | 2004/090285 | A1 | | 10/2004 | |

OTHER PUBLICATIONS

Canadian Office Action dated Mar. 11, 2020, from Canadian Application No. 3,014,816, 5 sheets.
Canadian Office Action dated Dec. 18, 2019.
Office Action for Canadian Patent Application No. 2,987,662 dated Feb. 20, 2018.
Office Action for Canadian Patent Application No. 3,014,816 dated Oct. 30, 2018.
Y. Tan, W. H. Moase, C Manzie, D. Nešić, and I. M. Y. Mareels, Extremum Seeking From 1922 to 2010, Proceedings of the 29th Chinese Control Conference, Jul. 29-31 in Beijing, China.
Krstić, Miroslav, and Hsin-Hsiung Wang, "Stability of extremum seeking feedback for general nonlinear dynamic systems." Automatica 36.4 (2000): 595-601.
Tan, Ying, Dragan Nesic and Iven Mareels. "On the choice of dither in extremum seeking systems: A cast study." Automatica 44.5 (2008): 1446-1450.
Dupriest, Fred E., et al. "Maximizing Drill Rates with Real-Time Surveillance of Mechanical Specific Energy." Paper prepared for SPE/IADC 92194 Drilling Conference held in Amsterdam, The Netherlands, Feb. 23-25, 2005.
Pason, Drilling Advisor System (DAS), first distributed Sep. 9, 2015, 2 pages.
Office Action for Canadian Patent Application No. 3,095,021 dated Jan. 28, 2022, 4 sheets.
Office Action for Canadian Patent Application No. 2,987,662 dated Feb. 20, 2018, 2 sheets.
Examination Search Report for Canadian Patent Application No. 2,987,662 with a search report dated Feb. 19, 2018, 2 sheets.
Notice of Allowance for Canadian Patent Application No. 2,987,662 dated Apr. 3, 2018, 1 sheet.
Mar. 13, 2018 Response to Official Action for Canadian Patent Application No. 2,987,662, 3 sheets.
Office Action for Canadian Patent Application No. 2,987,662 dated Feb. 20, 2018, 4 sheets.
Tan et al., Extremum Seeking From 1922 to 2010, Proceedings of the 29th Chinese Control Conference, Jul. 29-31, 2010, Beijing, China.
The Pason AutoDriller—Optimal Drilling Control and Accuracy. Last Accessed Jan. 18, 2017 from <https://pason.com/images/Product_Application_Notes/docu214_en_autodri-ller_product_application_note.pdf>.
Krstic, Miroslav, and Hsin-Hsiung Wang, "Stability of extremum seeking feedback for general nonlinear dynamic systems." Automatica 36 (2000): 595-601.
Ariyur, Kartik B., and Miroslav Krstic, Real-time optimization by extremum-seeking control, John Wiley & Sons, 2003.
Krstic, Miroslav, "Performance improvement and limitations in extremum seeking control." Systems & Control Letters 39.5 (2000): 313-326.
Tan, Ying, Dragan Nesic, and Iven Mareels. "On the choice of dither in extremum seeking systems: A case study." Automatica 44.5 (2008): 1446-1450.
Notice of Allowance for U.S. Pat. No. 10,202,837 dated Sep. 28, 2018, 27 sheets.

* cited by examiner

METHODS AND SYSTEMS FOR PERFORMING AUTOMATED DRILLING OF A WELLBORE

TECHNICAL FIELD

The present disclosure is directed at methods and systems for performing automated drilling of a wellbore.

BACKGROUND

The drilling of a wellbore typically requires transecting a set of subsurface geological formations with heterogenous lithology. The identification and classification of the lithology into formations can be carried out through well logging to provide a localized map used for current and future adjacent wellbores. Well logging provides information about the composition and physical properties of the rock being drilled (e.g. type, hardness and abrasiveness), these being important for effective well-planning including the proper selection of physical equipment, such as the type of drill bit, and the set of drilling parameters used during the wellbore drilling process. For example, drilling parameter inputs to the process, such as weight-on-bit (WOB) and rotary speed (RPM) may be specified during the well-planning process depending on the rock properties identified from analysis of well lots, to maintain proper bit-rock contact, depth of cut (DOC), and to prevent or mitigate prolonged occurrences of stick slip or bit whirl leading to premature or excessive wear on the drill bit. However, the true formation heterogeneity cannot be completely estimated from well logs, and unexpected changes must be handled through active management of the drilling parameters.

One type of change in operating conditions results from abrupt transitions between lithologies exhibiting significant differences in physical characteristics. For example, drilling through a set or sequence of interbedded formations with significant differences in compressive strength (e.g. coal and pyrite seams) can lead to large variations in the speed of drilling observed at the surface, corresponding to potentially damaging accelerations or decelerations of the downhole drill bit and bottom hole assembly (BHA) components, bit whirl, or stick slip. Short, interbedded layers of distinct rock types are sometimes called "stringers" and typically require active management of the drilling parameters to mitigate negative effects on the drilling equipment. "Hard stringers" refer to short intervals of relatively hard rock and "soft stringers" refer to short intervals of relatively soft rock. The occurrence, frequency and magnitude of stringers can be unpredictable and highly variable throughout the entire wellbore.

SUMMARY

In a first aspect of the disclosure, there is provided a method of performing automated drilling of a wellbore, comprising: drilling the wellbore according to one or more drilling parameter targets associated with one or more corresponding drilling parameters; determining that a controlling drilling parameter of the one or more drilling parameters is outside a threshold window; and in response thereto, updating one or more controlled drilling parameter targets of the one or more drilling parameter targets, wherein the controlled drilling parameter targets comprise a revolutions per minute (RPM) target and weight-on-bit (WOB) target.

Thus, the changes in the drilling process operating conditions associated with hard or soft stringers can be identified from real-time drilling parameter data. For example, given a relatively constant set of drilling parameter inputs, such as WOB and RPM, a hard stringer may be classified based on a relatively significant and/or sudden decrease in surface Rate of Penetration (ROP), and/or a relatively significant and/or sudden increase in Mechanical Specific Energy (MSE). On the other hand, a soft stringer may be classified based on a relatively significant and/or sudden increase in ROP and/or a relatively significant and/or sudden significant decrease in MSE.

The method may further comprise drilling the wellbore according to the updated one or more controlled drilling parameter targets. The method may further comprise: further determining that the controlling drilling parameter is outside the threshold window; and in response thereto, further updating the one or more controlled drilling parameter targets. Further updating the one or more controlled drilling parameter targets may comprise further updating the one or more controlled drilling parameter targets a predetermined period of time after the further determining that the controlling drilling parameter is outside the threshold window.

The one or more drilling parameter targets may further comprise one or more of a differential pressure target, a torque target, and a mechanical specific energy (MSE) target.

The MSE target may be determined according to one or more of: WOB, RPM, torque, differential pressure, mud flow rate, bit diameter, mud motor speed to flow ratio, a maximum mud motor torque, and a maximum differential pressure.

The controlling drilling parameter may comprise at least one of ROP and MSE.

The threshold window may be continuously determined.

The threshold window may be determined using a moving average of the controlling drilling parameter. The threshold window may be determined according to: [−max(cd.lower.limit.fixed, cd.beta*MovingAverage);+max(cd.upper.limit, cd.beta*MovingAverage)], wherein cd.lower.limit.fixed and cd.upper.limit are constants, cd.beta is a constant comprised in the range [0; 1], and MovingAverage is a moving average of the controlling drilling parameter. The threshold window may comprise a single value.

Updating the one or more controlled drilling parameter targets may comprise determining that updating the one or more controlled drilling parameter targets does not violate one or more safety conditions. The one or more safety conditions may comprise one or more of: the updated one or more controlled drilling parameter targets being within predetermined limits, and one or more other drilling parameter targets of the one or more drilling parameter targets being within predetermined limits.

Determining that the controlling drilling parameter is outside the threshold window may comprise determining that ROP is less than a lower limit of the threshold window, or that MSE has exceeded an upper lower limit of the threshold window; and updating the one or more controlled drilling parameter targets comprises at least one of reducing the RPM target and increasing the WOB target.

Determining that the controlling drilling parameter is outside the threshold window may comprise determining that ROP has exceeded an upper limit of the threshold window, or that MSE is less than a lower limit of the threshold window; and updating the one or more controlled drilling parameter targets comprises at least one of increasing the RPM target and decreasing the WOB target.

Updating the one or more controlled drilling parameter targets may comprise: determining the updated one or more controlled drilling parameter targets; and adjusting over a period of time the one or more controlled drilling parameter targets until the one or more controlled drilling parameter targets are within a predetermined range of the updated one or more controlled drilling parameter targets.

Updating the one or more controlled drilling parameter targets may comprise adjusting the one or more controlled drilling parameter targets by a preset amount.

Updating the one or more controlled drilling parameter targets may comprise adjusting the one or more controlled drilling parameter targets using one or more historical controlled drilling parameter targets. Each historical controlled drilling parameter target may be associated with a formation type, and the method may further comprise: determining a type of formation through which drilling is proceeding; and prior to adjusting the one or more controlled drilling parameter targets, filtering the one or more historical controlled drilling parameter targets based on the type of formation through which drilling is proceeding and based on the respective formation type associated with each historical controlled drilling parameter target. The formation type may comprise a hard formation, a normal formation, or a soft formation. The method may further comprise, after a predetermined period of time has elapsed since determining that the controlling drilling parameter is outside the threshold window, associating at least one historical controlled drilling parameter target with a normal formation.

Drilling the wellbore according to the one or more drilling parameter targets may comprise: drilling the wellbore according to a first drilling parameter target, wherein the first drilling parameter target comprises a first drilling parameter offset modified by a first drilling parameter perturbation signal; measuring a first drilling performance metric to determine a measured first drilling performance metric, wherein the first drilling performance metric is indicative of a response of the drilling to the first drilling parameter target; determining an output of a first objective function using the measured first drilling performance metric; determining a first correlation between the output of the first objective function and the first drilling parameter perturbation signal; determining an integral of the first correlation; updating the first drilling parameter target using the integral of the first correlation modified by the first drilling parameter perturbation signal; and after the first drilling parameter target has been updated, drilling the wellbore according to the first drilling parameter target. The drilling of the wellbore according to the first drilling parameter target may occur in response to determining that one or more controlled drilling parameters are within a predetermined range of their corresponding one or more controlled drilling parameter targets.

Drilling the wellbore according to the updated one or more controlled drilling parameter targets may comprise: drilling the wellbore according to a first drilling parameter target, wherein the first drilling parameter target comprises a first drilling parameter offset modified by a first drilling parameter perturbation signal; measuring a first drilling performance metric to determine a measured first drilling performance metric, wherein the first drilling performance metric is indicative of a response of the drilling to the first drilling parameter target; determining an output of a first objective function using the measured first drilling performance metric; determining a first correlation between the output of the first objective function and the first drilling parameter perturbation signal; determining an integral of the first correlation; updating the first drilling parameter target using the integral of the first correlation modified by the first drilling parameter perturbation signal; and after the first drilling parameter target has been updated, drilling the wellbore according to the first drilling parameter target. The drilling of the wellbore according to the first drilling parameter target may occur in response to determining that one or more controlled drilling parameters are within a predetermined range of their corresponding one or more controlled drilling parameter targets.

The actions of drilling the wellbore according to the first drilling parameter target through to after the first drilling parameter target has been updated may be iteratively performed at a sampling frequency used to measure the first drilling performance metric.

Determining the first correlation may comprise measuring the response of the automated drilling to the first drilling parameter target to determine a measured first drilling parameter; determining a first drilling parameter perturbation signal delay from a correlation between the first drilling parameter perturbation signal and the measured first drilling parameter; and delaying the first drilling parameter perturbation signal by the first drilling parameter perturbation signal delay prior to using the first drilling parameter perturbation signal to determine the first correlation.

The first correlation may be normalized to be between [−1,1].

The method may further comprise drilling the wellbore according to a second drilling parameter target, wherein the second drilling parameter target comprises a second drilling parameter offset modified by a second drilling parameter perturbation signal; measuring a second drilling performance metric to determine a measured second drilling performance metric, wherein the second drilling performance metric is indicative of a response of the drilling to the second drilling parameter target; determining an output of a second objective function using the second drilling performance metric; determining a second correlation between the output of the second objective function and the second drilling parameter perturbation signal; determining an integral of the second correlation; updating the second drilling parameter target using the integral of the second correlation modified by the second drilling parameter perturbation signal; and after the second drilling parameter target has been updated, drilling the wellbore according to the second drilling parameter target.

The actions of drilling the wellbore according to the second drilling parameter target through to after the second drilling parameter target has been updated may be iteratively performed at a sampling frequency used to measure the second drilling performance metric.

Determining the second correlation may comprise measuring the response of the automated drilling to the second drilling parameter target to determine a measured second drilling parameter; determining a second drilling parameter perturbation signal delay from a correlation between the second drilling parameter perturbation signal and the measured second drilling parameter; and delaying the second drilling parameter perturbation signal by the second drilling parameter perturbation signal delay prior to using the second drilling parameter perturbation signal to determine the second correlation.

The second correlation may be normalized to be between [−1,1].

The first drilling performance metric may be rate of penetration, mechanical specific energy, or stick-slip severity, and the second drilling performance metric may be rate of penetration, mechanical specific energy, or stick-slip severity.

The first and second objective functions may be identical.

Each of the first and second drilling parameter perturbation signals may be sinusoidal.

The first and second drilling parameter perturbation signals may have different frequencies.

Updating the first drilling parameter target using the integral of the first correlation may comprise applying a limit check to the integral of the first correlation; when the integral of the first correlation is less than a minimum first parameter limit, updating the first drilling parameter target using the minimum first parameter limit; and when the integral of the first correlation exceeds a maximum first parameter limit, updating the first drilling parameter target using the maximum first parameter limit.

Updating the second drilling parameter target using the integral of the second correlation may comprise applying a limit check to the integral of the second correlation; when the integral of the second correlation is less than a minimum second parameter limit, updating the second drilling parameter target using the minimum second parameter limit; and when the integral of the second correlation exceeds a maximum second parameter limit, updating the second drilling parameter target using the maximum second parameter limit.

The first drilling parameter target may be a weight-on-bit target and the second drilling parameter target may be a rotation rate target.

The second drilling parameter perturbation signal may have a frequency twice that of the first drilling parameter perturbation signal.

Each of the first and second drilling performance metrics may be rate of penetration and the method may further comprise, prior to determining the second correlation, removing from the measured second drilling performance metric a portion of the rate of penetration attributed to stretching and compression of a drill string used to drill the wellbore.

The measured first drilling parameter may comprise a non-linear and delayed response to the first drilling parameter target, and the method may further comprise determining the portion of the measured second drilling performance metric attributed to stretching and compression of the drill string from the measured first drilling parameter and the measured second drilling performance metric.

The first drilling parameter perturbation signal may be sin(ωt), the second drilling parameter perturbation signal may be sin(2 ωt), and the portion of the measured second drilling performance metric attributed to stretching and compression of the drill string may be determined as $$2kS_{W2}\cos(2\omega t) - 2kC_{W2}\sin(2\omega t),$$

$$\text{wherein } k = \frac{\text{corr}(ROP_{measured}, \cos(\omega(t-d)))}{\text{corr}(WOB_{actual}, \sin(\omega(t-d)))},$$

$$S_{W2} = \frac{2}{N}\text{corr}(WOB_{actual}, \sin(2\omega t)),$$

$$C_{W2} = \frac{2}{N}\text{corr}(WOB_{actual}, \cos(2\omega t)),\ N = TF_s,$$

ω is the angular frequency of the first drilling parameter perturbation signal, $$T = \frac{2\pi}{\omega},$$

$F_s$ is a sampling frequency used to obtain the measured first and second drilling parameters, d is the first drilling parameter perturbation signal delay, $ROP_{measured}$ is measured rate of penetration, and $WOB_{actual}$ is measured weight on bit, and corr($WOB_{actual}$, cos(2 ωt)) is a dot-product of $WOB_{actual}$ and cos(2 ωt).

One or both of the first and second objective functions may be $$J = \frac{ROP^c}{T^a N^b},$$

wherein J is the output of the first and second objective functions, ROP is the rate of penetration, T is torque applied to the drill string, and N is revolutions per minute of the drill bit.

One or both of the first and second objective functions may be $$J = \frac{ROP^c}{WOB^a N^b},$$

wherein J is the output of the first objective function, ROP is the rate of penetration, WOB is weight-on-bit, and N is revolutions per minute of the drill bit.

One or both of the first and second objective functions may be $$J = \frac{ROP^c}{DIFP^a N^b},$$

wherein J is the output of the first objective function, ROP is the rate of penetration, DIFP is differential pressure, and N is revolutions per minute of the drill bit.

In a further aspect of the disclosure, there is provided a method for performing automated drilling of a wellbore, comprising: drilling the wellbore according to one or more drilling parameter targets associated with one or more corresponding drilling parameters; determining a formation type through which the drilling is proceeding; and categorizing the one or more drilling parameter targets according to the formation type through which the drilling is proceeding. The method may further comprise determining that a controlling drilling parameter of the one or more drilling parameters is outside a threshold window; in response thereto, determining a new formation type through which the drilling is proceeding; and updating, using the one or more drilling parameter targets categorized according to the new formation type, one or more controlled drilling parameter targets of the one or more drilling parameter targets.

The controlled drilling parameter targets may comprise a revolutions per minute (RPM) target and weight-on-bit (WOB) target.

The formation type may comprise a hard formation, a normal formation, or a soft formation.

Updating the one or more controlled drilling parameter targets may comprise setting the one or more controlled drilling parameter targets equal to an average of the one or more drilling parameter targets categorized according to the new formation type. Updating the one or more controlled drilling parameter targets may comprise setting the one or more controlled drilling parameter targets equal to an average of a subset of the one or more drilling parameter targets categorized according to the new formation type. The subset may be determined according to a rolling window of the one or more drilling parameter targets.

In a further aspect of the disclosure, there is provided a method for performing automated drilling of a wellbore, comprising: drilling the wellbore according to one or more drilling parameter targets associated with one or more corresponding drilling parameters; determining a formation type through which the drilling is proceeding; determining that a controlling drilling parameter of the one or more drilling parameters is outside a threshold window; and in response thereto, updating, using one or more historical drilling parameter targets categorized according to the formation type, one or more controlled drilling parameter targets of the one or more drilling parameter targets.

In a further aspect of the disclosure, there is provided a system for performing automated drilling of a wellbore. The system comprises: a height control apparatus configured to adjust a height of a drill string used to drill the wellbore; a height sensor; a rotational drive unit comprising a rotational drive unit controller and a rotation rate sensor; a depth sensor; a hookload sensor; a drilling controller communicatively coupled to the rotational drive unit controller, the rotation rate sensor, the height control apparatus, the height sensor, the depth sensor, and the hookload sensor, the drilling controller configured to perform any of the above-described methods.

The drilling controller may comprise: a rotational drive controller communicatively coupled to the rotational drive unit controller and rotation rate sensor; an automated drilling unit communicatively coupled to the height control apparatus, the height sensor, the depth sensor, and the hookload sensor; and a processor communicatively coupled to the rotational drive controller and automated drilling unit and configured to perform any of the above-described methods.

The system may further comprise a standpipe pressure sensor and a torque sensor, each communicatively coupled to the drilling controller.

In a further aspect of the disclosure, there is provided a non-transitory computer-readable medium having stored thereon program code executable by a processor and configured, when executed, to cause the processor to perform any of the above-described methods.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more example embodiments.

DETAILED DESCRIPTION

In a conventional automated drilling system, an automated drilling unit varies a drilling parameter in order to adjust the rate of penetration ("ROP") of a drill bit through a formation. The automated drilling system uses a stepped input signal to change the magnitude of the drilling parameter and waits until the response of the drilling rig sufficiently settles before averaging that response. In view of the response, the automated drilling system again changes the drilling parameter. Drilling in this manner is laborious and relatively inefficient.

Described herein are methods, systems, and techniques in which a processor modifies an input signal used to control drilling using a perturbation signal. The input signal represents a drilling parameter such as block velocity, weight on bit ("WOB"), surface revolutions per minute ("RPM"), bit RPM, and differential pressure across a mud motor. The real time input and response, as represented by output measurements, of the drilling rig while drilling the wellbore are used to evaluate an objective function. The output of the objective function is correlated with a delayed version of the perturbation signal to determine the next input signal to be used to control drilling. This process effectively performs extremum seeking on the objective function that a driller wishes to maximize or minimize. The objective function comprises a drilling performance metric, such as ROP, drilling efficiency, bit wear, or depth of cut (ROP/RPM), which is indicative of how well drilling is progressing. In at least some example embodiments, a drilling performance metric is a subset of a drilling parameter, with drilling parameters that do not qualify as drilling performance metrics being parameters that are not indicative of how well drilling is progressing. This process is iterative, and in certain embodiments, is discrete in time and performed at the rate at which the drilling parameter is sampled. In certain embodiments, one or both of multiple drilling parameters and multiple drilling performance metrics may be used to seek the objective function's extremum.

Figure 1:
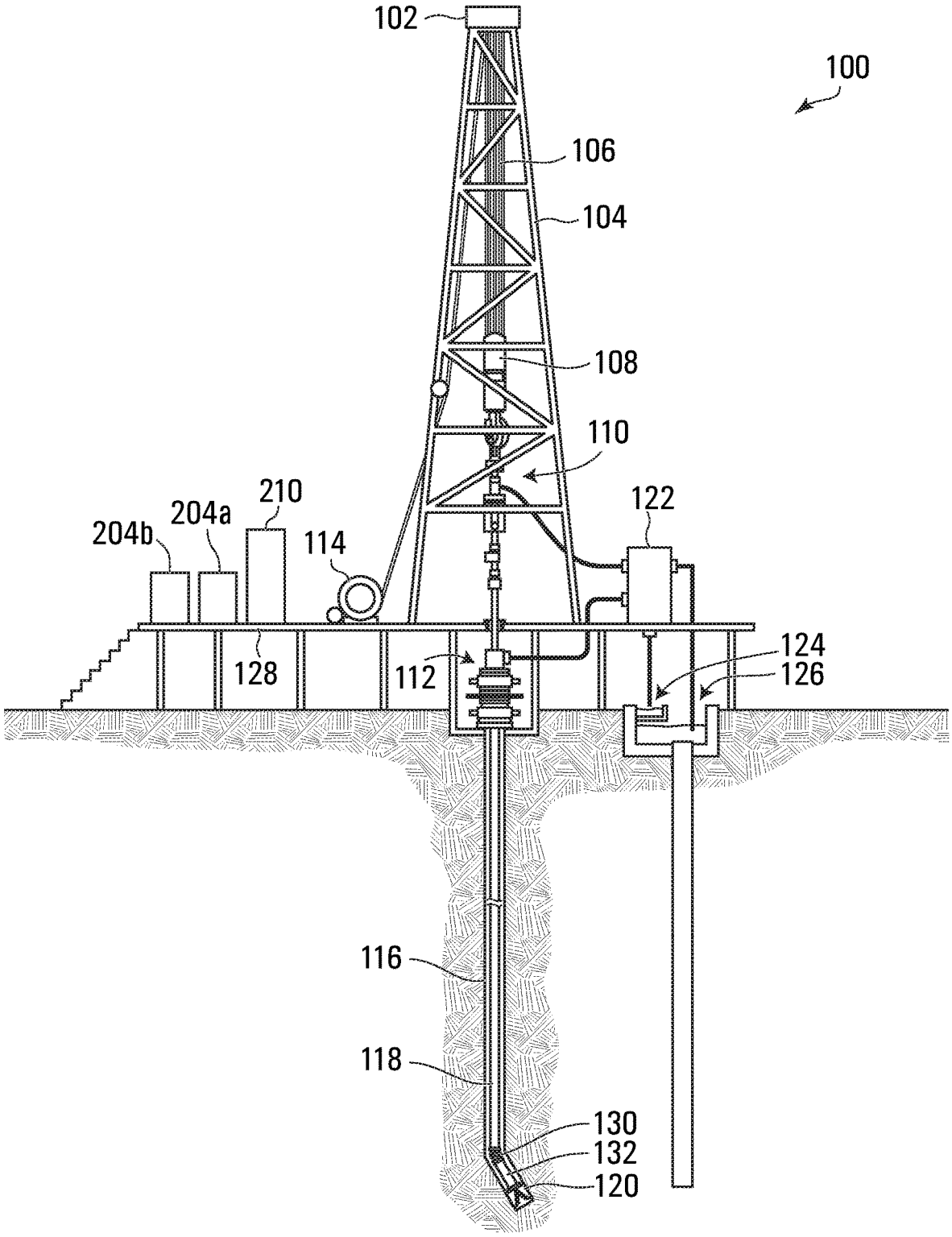
FIG. 1 is a schematic of a drilling rig, according to one embodiment.

FIG. 1 shows a drilling rig 100, according to one embodiment. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a traveling block 108 via a crown block 102. The traveling block 108 is connected to the drill string 118 via a top drive 110. Rotating the drawworks 114 consequently is able to change WOB during drilling, with rotation in one direction lifting the traveling block 108 and generally reducing WOB and rotation in the opposite direction lowering the traveling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Figure 2:
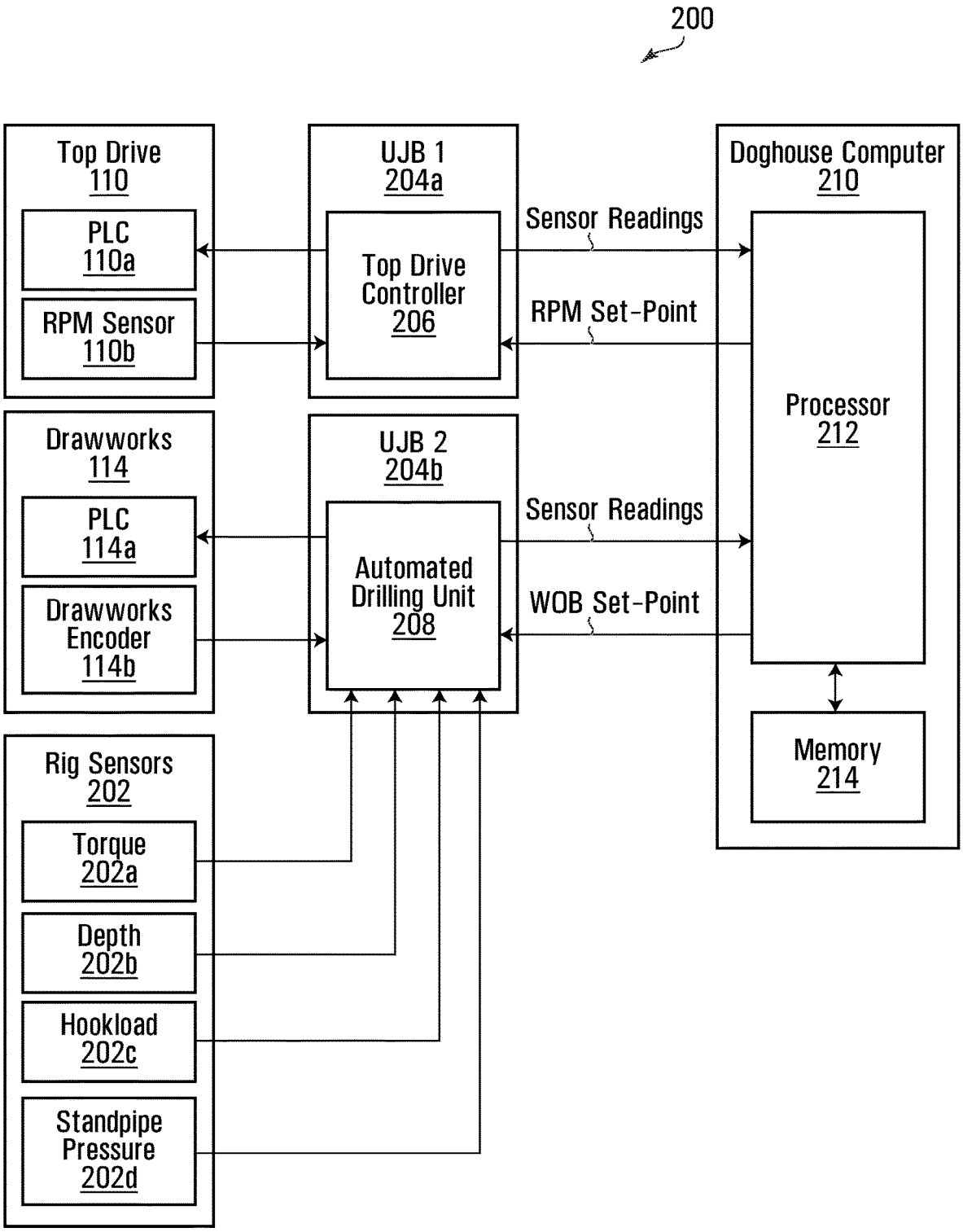
FIG. 2 is a block diagram of a system for performing automated drilling of a wellbore, according to the embodiment of FIG. 1.

FIG. 2 shows a block diagram of a system 200 for performing automated drilling of a wellbore, according to the embodiment of FIG. 1. The system 200 comprises various rig sensors: a torque sensor 202*a*, depth sensor 202*b*, hookload sensor 202*c*, and standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the traveling block 108. The top drive 110 comprises a top drive programmable logic controller ("top drive PLC") 110*a* that controls the top drive's 114 rotation and an RPM sensor 110*b* that outputs the rotational rate of the drill string 118. More generally, the top drive PLC 110*a* is an example of a rotational drive unit controller and the RPM sensor 110*b* is an example of a rotation rate sensor.

A first junction box 204*a* houses a top drive controller 206, which is communicatively coupled to the top drive PLC 110*a* and the RPM sensor 110*b*. The top drive controller 206 controls the rotation rate of the drill string 118 by instructing the top drive PLC 110*a* and obtains the rotation rate of the drill string 118 from the RPM sensor 110*b*.

A second junction box 204*b* houses an automated drilling unit 208, which is communicatively coupled to the drawworks PLC 114*a* and the drawworks encoder 114*b*. The automated drilling unit 208 modulates WOB during drilling by instructing the drawworks PLC 114*a* and obtains the height of the traveling block 108 from the drawworks encoder 114*b*. In different embodiments, the height of the traveling block 108 can be obtained digitally from rig instrumentation, such as directly from the PLC 114*a* in digital form. In different embodiments (not depicted), the junction boxes 204*a*,204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the ROP of the drill bit 120 by monitoring the height of the traveling block 108 over time.

The system 200 also comprises a doghouse computer 210. The doghouse computer 210 comprises a processor 212 and memory 214 communicatively coupled to each other. The memory 214 stores on it computer program code that is executable by the processor 212 and that, when executed, causes the processor 212 to perform a method 500 for performing automated drilling of the wellbore 116, such as that depicted in FIG. 5. The processor 212 receives readings from the RPM sensor 110*b*, drawworks encoder 114*b*, and the rig sensors 202, and sends an RPM target and a WOB target to the top drive controller 206 and automated drilling unit 208, respectively. The top drive controller 206 and automated drilling unit 208 relay these targets to the top drive PLC 110*a* and drawworks PLC 114*a*, respectively, where they are used for automated drilling. More generally, the RPM target is an example of a rotation rate target.

Each of the first and second junction boxes may comprise a Pason Universal Junction Box™ (UJB) manufactured by Pason Systems Corp. of Calgary, Alberta. The automated drilling unit 208 may be a Pason Autodriller™ manufactured by Pason Systems Corp. of Calgary, Alberta.

The top drive controller 110, automated drilling unit 208, and doghouse computer 210 collectively comprise an example type of drilling controller. In different embodiments, however, the drilling controller may comprise different components connected in different configurations. For example, in the system 200 of FIG. 2, the top drive controller 110 and the automated drilling unit 208 are distinct and respectively use the RPM target and WOB target for automated drilling. However, in different embodiments (not depicted), the functionality of the top drive controller 206 and automated drilling unit 208 may be combined or may be divided between three or more controllers. In certain embodiments (not depicted), the processor 212 may directly communicate with any one or more of the top drive 110, drawworks 114, and sensors 202. Additionally or alternatively, in different embodiments (not depicted) automated drilling may be done in response to only the RPM target, only the WOB target, one or both of the RPM and WOB targets in combination with additional drilling parameters, or targets based on drilling parameters other than RPM and WOB. Examples of these additional drilling parameters comprise differential pressure, an ROP target, depth of cut, torque, and flow rate (into the wellbore 116, out of the wellbore 116, or both).

In the depicted embodiments, the top drive controller 110 and the automated drilling unit 208 acquire data from the sensors 202 discretely in time at a sampling frequency $F_s$, and this is also the rate at which the doghouse computer 210 acquires the sampled data. Accordingly, for a given period T, N samples are acquired with $N=TF_s$. In different embodiments (not depicted), the doghouse computer 210 may receive the data at a different rate than that at which it is sampled from the sensors 202. Additionally or alternatively, the top drive controller 110 and the automated drilling unit 208 may sample data at different rates, and more generally in embodiments in which different equipment is used data may be sampled from different sensors 202 at different rates.

Figure 3:
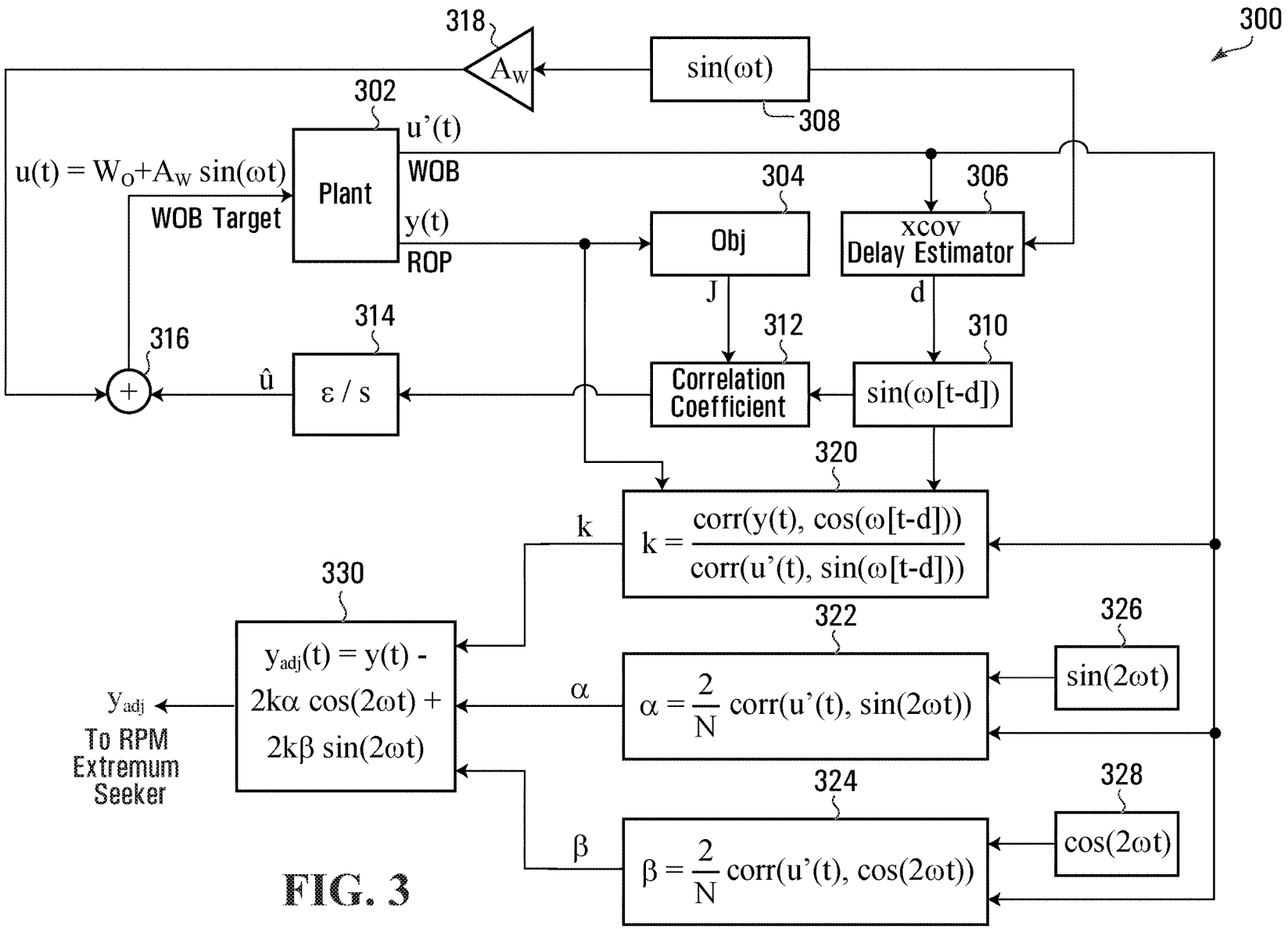
FIG. 3 is a block diagram of a system for seeking an objective function extremum based on weight on bit ("WOB"), according to the embodiment of FIG. 1.

Referring now to FIG. 3, there is shown a block diagram of a system 300 for seeking an objective function extremum based on WOB, which is expressed in the computer program code stored in the memory 214 and performed by the processor 212 when that code is executed. The system 300 of FIG. 3 attempts to maximize the objective function by drilling in response to an initial WOB target that comprises a time varying WOB perturbation signal, observing how drilling is performed in response to that initial target, and then updating the WOB target in view of that observed response and drilling using that updated target. And in FIG. 4, there is shown a block diagram of a system 400 for seeking an objective function extremum based on RPM, which is also expressed in the computer program code stored in the memory 214 and performed by the processor 212 when that code is executed. The system 400 of FIG. 4 attempts to maximize the objective function by drilling in response to an initial RPM target that comprises a time varying RPM perturbation signal, and then updating the RPM target in view of that observed response and drilling using that updated target. The processor 212 runs the systems 300,400 concurrently; however, in different embodiments (not depicted), the processor 212 may alternate operation of the systems 300,400 such that the processor 212 switches between maximizing the objective function in response to WOB using the system 300 of FIG. 3 and maximizing the objective function in response to RPM using the system 400 of FIG. 4. Different configurations are also possible. For example, in different embodiments (not depicted), the systems 300,400 may be replaced with one or more systems each of which uses as inputs multiple drilling parameters (e.g., the systems 300,400 may be replaced with a single system that uses both WOB and RPM as inputs, with the processor 212 modulating those inputs concurrently).

Figure 10A:
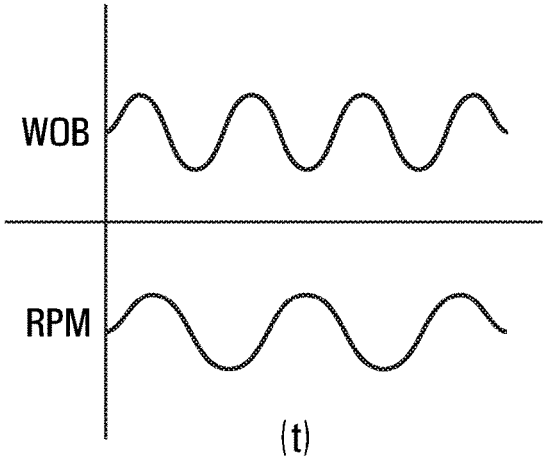
FIGS. 10A-10E depict how WOB and RPM may be modulated as inputs to the systems of FIGS. 3 and 4, respectively, according to additional example embodiments.
Figure 10B:
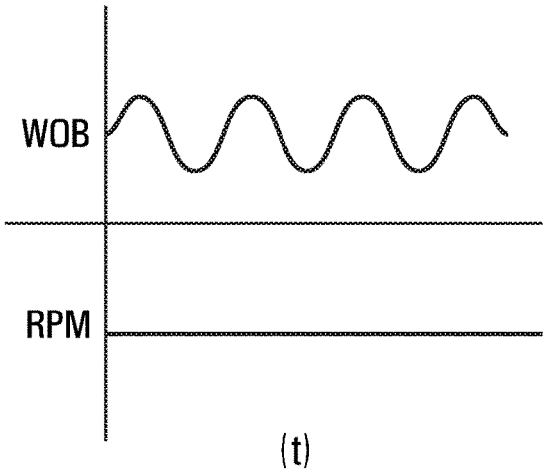
Figure 10C:
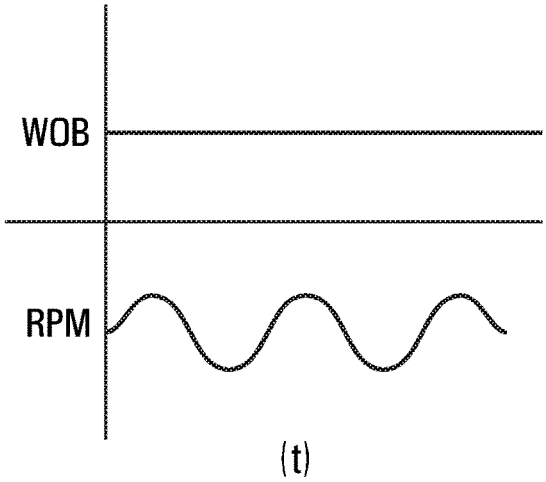
Figure 10D:
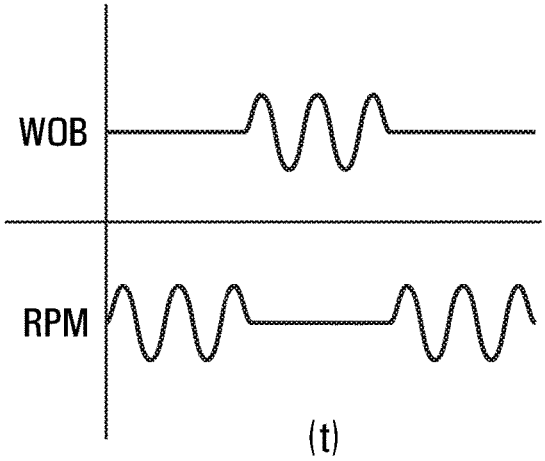
Figure 10E:
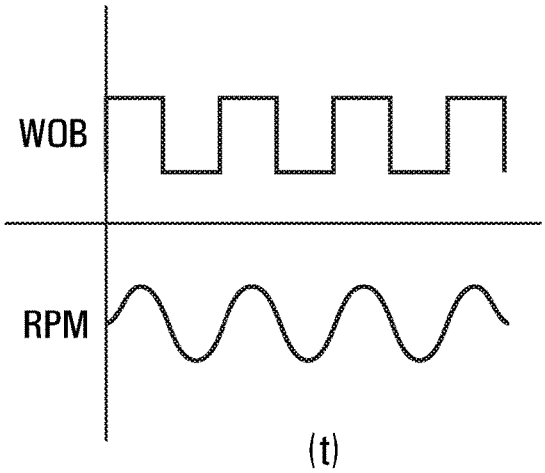

FIGS. 10A-10E show different ways in which the processor 212 may modulate the WOB and RPM inputs of the systems 300,400. In FIG. 10A, the processor 212 modulates the WOB and RPM inputs of the systems 300,400 concurrently. In another embodiment as shown in FIG. 10B, the processor 212 modulates the WOB input of the system 300 of FIG. 3 while holding the RPM input to the system 400 of FIG. 4 generally constant. In FIG. 10B, processor 212 may continue to evaluate the output of the system 400 of FIG. 4 without modifying its RPM input. In another embodiment shown in FIG. 10C, the processor 212 modulates the RPM input of the system 400 of FIG. 4 while holding the WOB input to the system 300 of FIG. 3 generally constant. In FIG. 10C, the processor 212 may continue to evaluate the output of the system 300 of FIG. 3 without modifying its WOB input. In another embodiment shown in FIG. 10D, the processor 212 evaluates the different systems 300,400 and modulates either WOB or RPM depending on a priority selecting method. The priority selecting method may select either of the systems 300,400 to be the controlling system based on time, depth, mechanical specific energy ("MSE"), or another suitable drilling parameter. In another example embodiment as depicted in FIG. 10E, one or more of the input signals input to the systems 300,400 can be non-sinusoidal and periodic.

In certain embodiments, drilling in this manner may result in one or more technical benefits. For example, concurrently attempting to maximize the objective function in view of multiple inputs, such as WOB and RPM, may help to increase the rate at which the objective function extremum is approached. Additionally, drilling in this manner is an iterative process, which may help the system adapt to changes such as changes in drilling environment characteristics and consequent changes in the objective function extremum. Drilling in this manner may also be relatively robust. Furthermore, drilling in this manner does not require a priori knowledge of models of the plants 302,402, which may be beneficial in that those models may be of non-linear or time-varying processes that are difficult to accurately model.

Examples of extremum seeking are discussed in more detail in Y. Tan, W. H. Moase, C. Manzie, D. Nešić, and I. M. Y. Mareels, *Extremum Seeking From* 1922 *to* 2010, Proceedings of the 29$^{th}$ Chinese Control Conference, July 29-31 in Beijing, China; Krstić, Miroslav, and Hsin-Hsiung Wang, "Stability of extremum seeking feedback for general nonlinear dynamic systems." *Automatica* 36.4 (2000): 595-601; Ariyur, Kartik B., and Miroslav Krstic, *Real-time optimization by extremum-seeking control*, John Wiley & Sons, 2003; and Krstić, Miroslav, "Performance improvement and limitations in extremum seeking control." *Systems & Control Letters* 39.5 (2000): 313-326, the entireties of all of which are hereby incorporated by reference herein.

The system 300 of FIG. 3 comprises a plant 302 with an unknown response. The plant 302 represents the automated drilling unit 208, sensors 202, and drilling rig 100. The processor 212 sends the WOB target (u(t)) to the plant 302, and in response the plant 302 outputs the WOB as measured by the hookload sensor 202*c* ("measured WOB") (u'(t)) and the ROP as measured using the drawworks encoder 114*b* (y(t)) to the processor 212. As used herein, a "measured" drilling parameter, examples of which comprise WOB and ROP, refers to a drilling parameter that has been directly or indirectly measured. For example, "measured MSE" in certain example embodiments may not be directly measured but instead indirectly measured by being determined from measurements of WOB, torque, ROP, and RPM. More generally, an indirectly measured drilling parameter comprises a drilling parameter determined using one or more direct measurements.

The WOB target that the processor 212 sends to the plant 302 has the form of Equation (1):

$$u(t)=W_o+A_W\sin(\omega t) \tag{1}$$

where $W_o$ is a WOB offset and $A_W\sin(\omega t)$ is a WOB perturbation signal having a perturbation amplitude $A_W$ and angular frequency ω.

Blocks 302-318 in the system 300 of FIG. 3 perform extremum seeking based on the WOB target. More particularly, the processor 212 generates the WOB perturbation signal at blocks 308 and 318, and the WOB perturbation signal is added to the WOB offset at an adder 316 to generate the WOB target. Generating the WOB offset is discussed in further detail below. The WOB target is then sent to the plant 302.

The plant 302 receives the WOB target from the processor 212, from which the processor 212 obtains the measured WOB and ROP using the hookload sensor 202*c* and drawworks encoder 114*b*, respectively. The measured WOB and ROP values are suitably conditioned by, for example, amplification and filtering prior to being used elsewhere in the system 300. The processor 212 uses the measured WOB and ROP to evaluate an objective function 304.

The processor 212 attempts to find an extremum of the objective function 304. In the depicted embodiment, the objective function 304 is as shown in Equation (1.1):

$$J = \frac{ROP^c}{T^a N^b} \tag{1.1}$$

where J is the output of the objective function, T is torque, N is drill bit RPM, and a, b, and c are exponents that determine the trade-off between drilling rate and energy expenditure. N may be measured RPM is certain example embodiments; in different example embodiments, N may be estimated. For example, N may be bit RPM estimated using flow rate measured at the surface and a specified and known mud motor speed-to-flow rate ratio in embodiments in which a mud motor is used and the mud motor speed-to-flow rate ratio is known.

In the depicted embodiment, a=1, b=1, and c=2. However, in different embodiments (not depicted), any one or more of these exponents may be selected differently. For example, in one non-depicted embodiment, a=b=0 and c=1, in which case the system 300 attempts to find the ROP extremum. The exponents a, b, and c may be determined empirically. The objective function's 304 output J is sent to a correlation coefficient block 312.

Generally, in at least some example embodiments, the objective function 304 is generally of the form ROP/Energy, with the product of torque and RPM in Equation (1.1) representing energy. In one example embodiment, the objective function 304 is as shown in Equation (1.2):

$$J = \frac{ROP^c}{WOB^a N^b} \tag{1.2}$$

In another example embodiment, the objective function 304 is as shown in Equation (1.3):

$$J = \frac{ROP^c}{DIFP^a N^b} \tag{1.3}$$

where DIFP is measured differential pressure. In Equations (1.1)-(1.3), the denominators generally relate to energy input to the rig 100 for drilling.

As the example objective functions of Equations (1.1)-(1.3) show, the objective functions in at least some example embodiments comprise multiple parameters, with at least one of those parameters comprising a drilling performance metric such as ROP. Any given objective function may comprise both one or more drilling performance metrics, such as ROP, MSE, and stick-slip severity, and one or more drilling parameters such as differential pressure and WOB.

In parallel with sending the measured WOB and ROP to the objective function 304, the measured WOB is sent to a cross-covariance delay estimator 306 where the processor 212 estimates a WOB perturbation signal delay d between the WOB perturbation signal from block 308 and the measured WOB from the plant 302. The delay is output to block 310, which generates a signal that has the same form as the WOB perturbation signal (in the depicted embodiment, a sine wave of frequency ω) and that is delayed by the delay ("delayed WOB perturbation signal"). The delayed WOB perturbation signal is sent to the correlation coefficient block 312.

At the correlation coefficient block 312, the processor 212 determines the correlation between the delayed WOB perturbation signal from block 310 and the output of the objective function 304. In the depicted embodiment, the processor 212 determines the Pearson correlation coefficient, although in different embodiments (not depicted) a different type of correlation may be used. The processor 212 determines the correlation on samples obtained during a window of time, which is the last $N=TF_s$ samples, where $F_s$ is the sample frequency in Hz and T is the period of the WOB perturbation signal in seconds. Determining the correlation coefficient between the perturbation signal and the output of the objective function on $N=TF_s$ samples results in removing of the DC component and smoothing of the signal. Therefore, the system 300 does not require low pass and high pass filters found in conventional extremum seeking systems.

The processor 212 integrates this correlation using an integrator 314. The integrator 314 comprises a gain scaling coefficient c that may be empirically determined. Example values for the gain scaling coefficient may vary with the sampling frequency. For example, when the sampling frequency is 5 Hz, the gain scaling coefficient may in certain embodiments be between [0.001,0.01]. The gain scaling coefficient may influence the trade-off between convergence rate to the extremum and relative stability of the target parameters. Lower values of the gain scaling coefficient result in relatively slow convergence but a lower chance of instability, while higher values permit relatively fast convergence but result in a higher chance of instability. The integrator's 314 output is the WOB offset, which is added to the WOB perturbation signal at the adder 316 to generate the WOB target that is fed to the plant 302.

The Pearson correlation coefficient is normalized between [−1,1]. Using a normalized correlation coefficient means that the correlation coefficient is between [−1,1] regardless of the output of the objective function 304, which permits the gain scaling coefficient E, comprising part of the integrator 314, to remain relatively unchanged regardless of the range of outputs of the objective function 304 and operating conditions. Normalization increases robustness of the method to temporary objective function anomalies such as spikes.

In operation, an initial WOB target is fed to the plant 302. In response to the plant's output to this initial WOB target, the processor 212 determines an updated WOB target as described above and sends the updated WOB target to the plant 302. This process iteratively repeats, with the goal of incrementally increasing the output of the objective function 304 based on the WOB with each iteration.

As the actual ROP is difficult to directly measure, the processor 212 estimates the ROP from the change in the position of the travelling block 108, which is obtained by the drawworks encoder 114*b*. The drill string 118 is sufficiently flexible that changes in WOB cause significant changes in the position of the block 108 due to one or both of drill string stretching and compression. Under certain conditions the magnitude of the block's 108 movement in response to WOB changes due to string stretching or compression is higher than the actual rock penetration. In certain embodiments, it can accordingly be useful account for string stretching and compression as described below.

In the system 300 of FIG. 3, the automated drilling unit 208, and consequently the plant 302, has a delayed, non-linear response. The measured WOB u'(t) accordingly has the form of Equation (2), which is also the form of a Discrete Fourier Transform:

$$u'(t)=W_{oa}+S_{W1}\sin(\omega(t-d))+S_{W2}\sin(2\omega t)+C_{W2}\cos(2\omega t)+ \quad (2)$$

where $W_{oa}$ is a constant, d is the delay of the measured WOB signal of frequency co relative to the WOB perturbation signal, $S_{W1}$ is the amplitude of the sine wave having the frequency of the WOB perturbation signal (2ω), and $S_{W2}$ and $C_{W2}$ are amplitudes of the sine and cosine waves having the frequency of the RPM perturbation signal (2ω). Without loss of generality the derivation included here only considers the first two frequencies for clarity, but may be completed for higher order frequencies. For example, in different embodiments (not depicted) in which more than two parameters such as WOB and RPM are used, Equation (2) may be completed for at least as many frequencies are there are parameters in embodiments in which the perturbation signal for each of the parameters is at different frequencies.

Equations (3) and (4) relate the measured ROP y(t) to the measured WOB:

$$y(t)=\mathrm{ROP}_{pipe}+\mathrm{ROP}_{bit} \quad (3)$$

$$ROP_{pipe}=k\frac{d}{dt}u'(t) \quad (4)$$

where $\mathrm{ROP}_{pipe}$ is the contribution to the measured ROP due to stretching or compression of the drill string 108, $\mathrm{ROP}_{bit}$ is the ROP at the bit 120, and k is the pipe stretch coefficient, which is inversely proportional to the spring coefficient of the drill string 118.

To compensate for string stretching and compression, $\mathrm{ROP}_{pipe}$ is removed from the measured ROP before evaluating the objective function. Substituting the measured WOB from Equation (2) into Equation (4) and taking the derivative results in Equation (5). As with Equation (2) above, without loss of generality the derivation of Equation (5) only considers the first two frequencies for clarity, but may be completed for higher order frequencies.

$$\mathrm{ROP}_{pipe}=kS_{W1}\cos(w(t-d))+2kS_{W2}\cos(2\omega t)-2kC_{W2}\sin(2\omega t)+ \quad (5)$$

Knowledge of the delay d permits the processor 212 to estimate k. As discussed above, the cross-covariance delay estimator 306 estimates the delay d from the WOB perturbation signal and the measured WOB. Finer time resolution (i.e., better than the resolution of the data samples) may in certain embodiments be achieved using quadratic interpolation.

The processor 212 determines the amplitude of the measured WOB at frequency co is determined by determining the correlation of the measured WOB with the delayed WOB perturbation signal, as shown in Equation (6). This amplitude is the Fourier coefficient $S_{W1}$ in Equation (2).

$$S_{W1}=\frac{2}{N}\mathrm{corr}(u'(t),\sin(\omega(t-d))) \quad (6)$$

where N is the number of WOB and ROP samples used and, in at least the current example embodiment, the operator corr(X, Y) is determined as the dot-product of the two sequences of numbers, X and Y.

Equation (7) follows from Equation (5):

$$kS_{W1}=\frac{2}{N}\mathrm{corr}(y(t),\cos(\omega(t-d))) \quad (7)$$

At block 320, the processor 212 estimates k by combining Equations (6) and (7):

$$k=\frac{\mathrm{corr}(y(t),\cos(\omega(t-d)))}{\mathrm{corr}(u'(t),\sin(\omega(t-d)))} \quad (8)$$

The processor 212 adjusts the measured ROP for the effects of the 2ω frequency component of the measured WOB by substituting the value of k into Equation (9), which follows from Equation (5):

$$y_{adj}=y(t)-2kS_{W2}\cos(2\omega t)+2kC_{W2}\sin(2\omega t) \quad (9)$$

where $S_{W2}$ and $S_{W2}$ are Fourier coefficients in Equation (2) that the processor 212 can determine using Equations (10) and (11):

$$S_{W2}=\alpha=\frac{2}{N}\mathrm{corr}(u'(t),\sin(2\omega t)) \quad (10)$$

$$C_{W2}=\beta=\frac{2}{N}\mathrm{corr}(u'(t),\cos(2\omega t)) \quad (11)$$

The processor 212 evaluates Equation (10) at block 322, Equation (11) at block 324, and outputs the adjusted ROP $y_{adj}$ at block 330.

Figure 4:
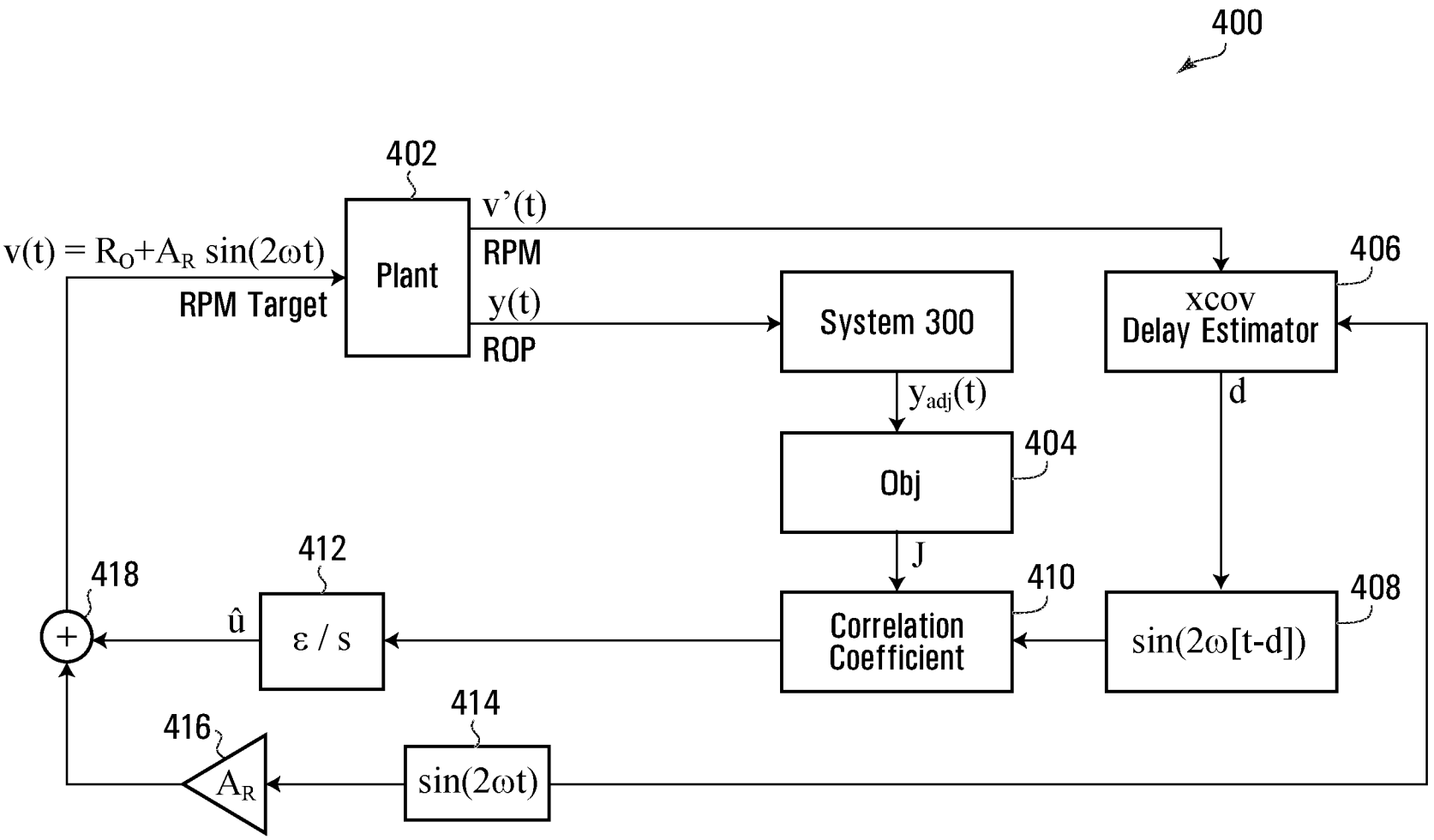
FIG. 4 is a block diagram of a system for seeking an objective function extremum based on rotation rate, according to the embodiment of FIG. 1.

Analogously, the system 400 of FIG. 4 comprises a plant 402 with an unknown response. The plant 402 represents the top drive controller 206 and drilling rig 100. The processor 212 sends the RPM target (v(t)) to the plant 402, and in response the plant 402 outputs the RPM as measured by the RPM sensor **110*b* ("measured RPM") (v'(t)) and the ROP as measured by the drawworks encoder 114*b* (y(t)) to the processor 212**.

The RPM target that the processor 212 sends to the plant 402 has the form of Equation (12):

$$v(t)=R_o+A_R\sin(2\omega t) \quad (12)$$

where $R_o$ is an RPM offset and $A_R$ sin(2 ωt) is an RPM perturbation signal having a perturbation amplitude $A_R$ and angular frequency 2ω.

Selecting the RPM perturbation signal to be twice the frequency of the WOB perturbation signal ensures that the WOB and RPM perturbation signals are orthogonal for the purposes of the systems 300,400: the correlation calculated on sample sequences W and R over a period of the WOB perturbation signal T equals zero regardless of the phases of the WOB and RPM perturbation signals:

$$W=\text{sequence of}(\sin(\omega t+\theta_1)),t=0:1/F_s:(T-1/F_s)$$

$$R=\text{sequence of}(\sin(2\omega t+\theta_2)),t=0:1/F_s:(T-1/F_s)$$

$$\text{corr}(W,R)=0\ \forall\theta_1,\theta_2 \tag{3}$$

where $F_s$ is the sample frequency in Hz.

In the depicted embodiments, sample sequences comprise N samples with $N=TF_s$. This ensures that WOB is represented by a sinusoid of frequency ω and RPM is represented by a sinusoid of frequency 2ω in the Discrete Fourier Transform of a sample sequence, as shown in Equation (2) above. Higher frequencies are ignored herein as they are orthogonal to the frequencies of interest.

Blocks 402-418 and 300 in the system 400 of FIG. 4 perform extremum seeking based on the RPM target. More particularly, the processor 212 generates the RPM perturbation signal at blocks 414 and 316, and the RPM perturbation signal is added to the RPM offset at an adder 418 to generate the RPM target. Generating the RPM offset is discussed in further detail below. The RPM target is then sent to the plant 402.

The plant 402 receives the RPM target from the processor 212, from which the processor 212 obtains the measured RPM and ROP using the hookload sensor 202*c* and drawworks encoder 114*b*, respectively. The measured RPM and ROP values are suitably conditioned by, for example, amplification and filtering prior to being used elsewhere in the system 400. The processor 212 uses the measured ROP to generate the adjusted ROP $y_{adj}$ using the system 300 of FIG. 3, as described above. The processor 212 then uses the adjusted ROP to evaluate an objective function 404 of the form provided in Equation (1.1), with the comments above made in respect of the objective function 304 of FIG. 3 also applying to the objective function 404 of FIG. 4. The objective function's 404 output J is sent to a correlation coefficient block 410. While in the depicted embodiment the same objective function is used in both of the systems 300,400, in different embodiments (not depicted) different objective functions may be used in the systems 300,400.

In parallel with sending the measured ROP to the system 300 to determine the adjusted ROP, the measured RPM is sent to a cross-covariance delay estimator 406 where the processor 212 estimates a rotation rate perturbation signal delay d between the RPM perturbation signal from block 414 and the measured RPM from the plant 402. The delay is output to block 408, which generates a signal that has the same form as the RPM perturbation signal (in the depicted embodiment, a sine wave of frequency 2ω) and that is delayed by the delay ("delayed RPM perturbation signal"). The delayed RPM perturbation signal is sent to the correlation coefficient block 410.

At the correlation coefficient block 410, the processor 212 determines the correlation between the delayed RPM perturbation signal from block 408 and the output of the objective function 404, in a manner analogous to how the processor 212 makes the analogous determination at block 312 as discussed above. The processor 212 integrates this correlation using an integrator 412, with the gain scaling coefficient c of the integrator 412 being empirically determined. Example values for the gain scaling coefficient may vary with the sampling frequency. For example, when the sampling frequency is 5 Hz, the gain scaling coefficient may in certain embodiments be between [0.01,0.1]. The gain scaling coefficient may influence the trade-off between convergence rate to the extremum and relative stability of the target parameters. Lower values of the gain scaling coefficient result in relatively slow convergence but a lower chance of instability, while higher values permit relatively fast convergence but result in a higher chance of instability. The integrator's 412 output is the RPM offset, which is added to the RPM perturbation signal at the adder 418 to generate the RPM target that is fed to the plant 402.

In operation, an initial RPM target is fed to the plant 402. In response to the plant's output to this initial RPM target, the processor 212 determines an updated RPM target as described above and sends the updated RPM target to the plant 402. This process iteratively repeats, with the goal of incrementally increasing the objective function based on the RPM with each iteration.

Figure 5:
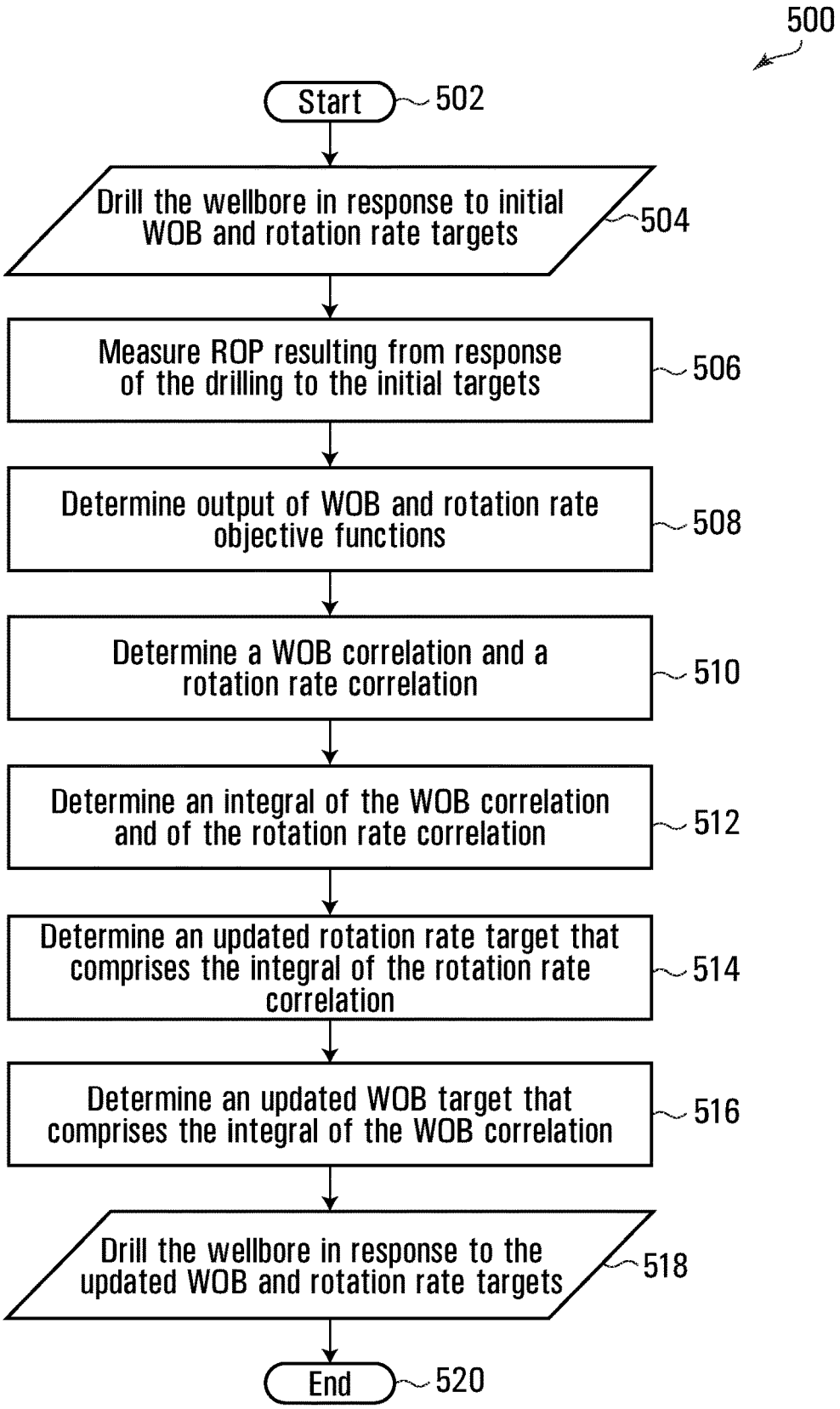
FIG. 5 is a method for performing automated drilling of a wellbore, according to the embodiment of FIG. 1.

Referring now to FIG. 5, there is shown a method 500 for performing automated drilling of the wellbore 116, according to the embodiment of FIG. 1. The method 500 is encoded as computer program code on to the memory 214 and is performed by the processor 214 in conjunction with the top drive controller 206, automated drilling unit 208, top drive 110, drawworks 114, and sensors 202 upon code execution. The processor 212 begins performing the method 500 at block 502 and proceeds to block 504 where it instructs the automated drilling unit 208 and top drive controller 206 to drill the wellbore 118 in response to the initial WOB target and an initial rotation rate target, such as the initial RPM target. Drilling in response to the initial WOB target is described in respect of FIG. 3 above as the input to block 302, and drilling in response to the initial RPM target is described in respect of FIG. 4 above as the input to block 402. As described above in respect of FIGS. 3 and 4, the initial WOB target comprises the initial WOB offset modified by the WOB perturbation signal and the initial RPM target comprises the initial RPM offset, which is an example of an initial rotation rate target, modified by the RPM perturbation signal, which is an example of a rotation rate perturbation signal. The driller may provide starting values for u(t) in FIGS. 3 and 4 for the first iteration of the systems 300,400.

Following block 504, the processor 212 proceeds to block 506 where it measures the ROP resulting from the response of the drilling to the initial WOB and rotation rate targets. An example of this is the processor 212 in FIGS. 3 and 4 obtaining the ROP y(t) from the plants 302,402 following their responses to the initial WOB and RPM targets.

Following block 506, the processor 212 proceeds to block 508 where it evaluates the objective functions 304,404 of the systems 300,400. In the depicted embodiment, the systems 300,400 use the same objective function as shown in Equation (1.1). However, in different embodiments (not depicted) the systems 300,400 may use different objective functions 304,404.

After evaluating the objective function at block 508, the processor 212 proceeds to block 510 where it determines a WOB correlation between the output of the objective function 304 of FIG. 3 and the WOB perturbation signal and a rotation rate correlation between the output of the objective function 404 of FIG. 4 and the rotation rate perturbation signal. This is described in respect of FIG. 3 above when the processor 212 performs block 312 to determine the correlation between the delayed WOB perturbation signal and the output of the objective function 304, and in respect of FIG. 4 above when the processor 212 performs block 410 to determine the correlation between the delayed RPM perturbation signal and the output of the objective function 404.

The processor 212 at block 512 then determines an integral of the WOB correlation and an integral of the rotation rate correlation. The processor 212 determines the integral of the WOB correlation in FIG. 3 using the integrator 314 and determines the integral of the rotation rate correlation in FIG. 4 using the integrator 412.

In one example embodiment (not depicted), the processor 212 applies a limit check to the outputs of the integrators 314,412 before using those outputs as inputs to the plants 302,402. The processor 212 may compare the output of the integrator 314 of FIG. 3 to minimum and maximum WOB limits, while the processor 212 may compare the output of the integrator 412 of FIG. 4 to minimum and maximum RPM limits. If the output of the integrator 314 of FIG. 3 is outside the WOB limits, then the processor 212 clips that output to the minimum or maximum WOB limit as appropriate and uses the clipped output as $W_0$. Similarly, if the output of the integrator 412 of FIG. 4 is outside the RPM limits, then the processor 212 clips that output to the minimum or maximum RPM limit as appropriate and uses the clipped output as $R_0$.

The WOB and RPM limits may be one or both of limits of the absolute value of the outputs of the integrators 314,412 and limits on the rates of change in those outputs from the last iteration of the systems 300,400. For example, in one embodiment in which the limit is a limit on rate of change, the minimum and maximum RPM limits may be −5 RPM and +5 RPM relative to the last iterations of the systems 300,400, respectively. More generally, the limits may be a minimum and a maximum limit expressed as a percentage change such as from the last iteration of the systems 300,400, a certain minimum or maximum number of absolute units (e.g., maximum of 5 RPM) or relative units (e.g., maximum of +5% relative to the last iteration), or both.

Following integration, the processor 212 at block 514 determines an updated WOB target comprising an updated WOB offset modified by the WOB perturbation signal, with the updated WOB offset comprising the integral of the WOB correlation. The processor 212 does this in FIG. 3 at the adder 316 by summing the updated WOB offset from block 314 with the WOB perturbation signal from block 318.

The processor 212 at block 516 also determines an updated rotation rate target comprising an updated rotation rate offset modified by the rotation rate perturbation signal, with the updated rotation rate offset comprising the integral of the rotation rate correlation. The processor 212 does this in FIG. 4 at the adder 418 by summing the updated RPM offset from block 412 with the RPM perturbation signal from block 416.

At block 518, the processor 212 drills the wellbore 116 in response to the updated WOB target and the updated rotation rate target. This is done in FIG. 3 by sending the updated WOB target to the plant 302, and in FIG. 4 by sending the updated RPM target to the plant 402. In certain embodiments, drilling the wellbore 116 in response to the updated targets may comprise alternating between drilling the wellbore 116 in response to the updated WOB target and drilling the wellbore in response to the updated rotation rate target. At block 520 the specific iteration of the method 500 ends.

In the depicted embodiment, the processor 212 performs a discrete time continuous process that iteratively updates the inputs to the plants 302,402 at the rate at which data is acquired; that is, the sampling frequency $F_s$. This is in contrast to a conventional automated drilling system in which the system step changes a drilling parameter and waits to get an averaged response from the system 200 before again changing that drilling parameter. In one embodiment, the sampling frequency is 1 Hz, and the period for completing a full perturbance cycle (i.e., a full period of a perturbation signal) is between 90 and 120 seconds.

In different embodiments (not depicted), the processor 212 may iterate at a rate different than the sampling frequency. For example, the processor 212 may iterate at a data update frequency, which is the frequency at which one or both of the top drive controller 206 and the automated drilling unit 208 update the top drive PLC 110*a* and drawworks PLC 114*a*, respectively. In one example embodiment, the sampling frequency is 1 Hz and the data update frequency is 5 Hz.

Example 1

Figure 6A:
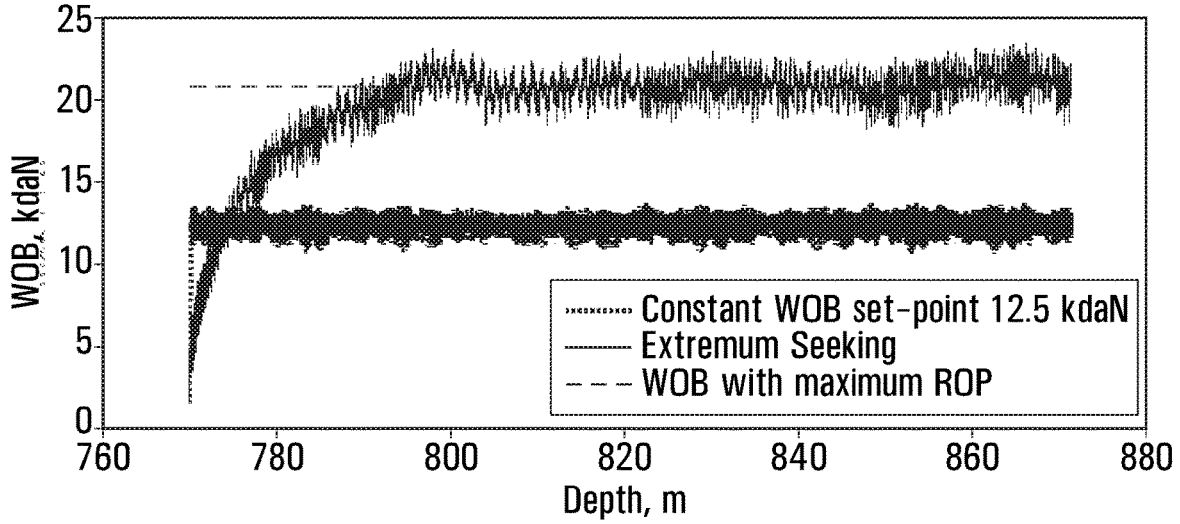
FIGS. 6A, 6B, and 6C depict 2D plots of WOB, revolutions per minute ("RPM"), and rate of penetration ("ROP"), respectively, versus drilling depth, according to one example embodiment.
Figure 6B:
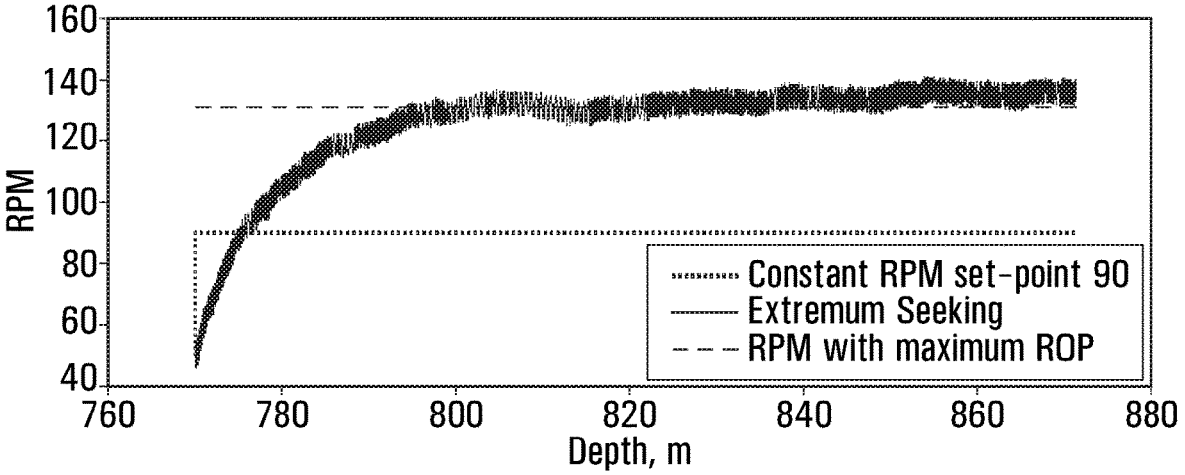
Figure 6C:
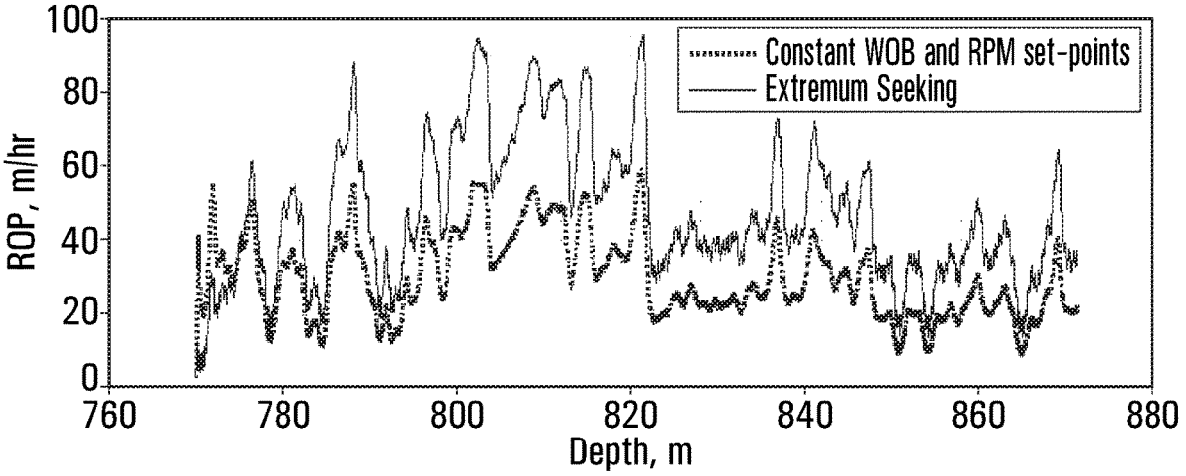

Referring now to FIGS. 6A, 6B, and 6C, there are depicted 2D plots of WOB, RPM, and ROP, respectively, versus drilling depth, according to one example embodiment in which the output of the objective functions 304,404 is set equal to ROP.

The long dashed line in FIG. 6A represents theoretical actual WOB at maximum ROP. The short dashed line in FIG. 6A represents measured WOB when the automated drilling unit 208 is set to maintain a constant WOB of 12.5 kdaN. The solid line in FIG. 6A represents measured WOB when applying the system 200 with the initial set point for WOB at 5 kdaN and for RPM at 50. The plot of FIG. 6A shows measured WOB when the system 200 is applied converging to the WOB corresponding to maximum ROP.

The long dashed line in FIG. 6B represents theoretical actual RPM at maximum ROP. The short dashed line in FIG. 6B represents measured RPM when the top drive controller 206 is set to maintain a constant rotation rate of 90 RPM. The solid line in FIG. 6B represents measured RPM when applying the system 200 with the initial set point for WOB at 5 kdaN and for RPM at 50. The plot of FIG. 6B shows measured RPM when the system 200 is applied converging to the RPM corresponding to maximum ROP.

The dashed line in FIG. 6C shows measured ROP when the automated drilling unit 208 is set to maintain a constant WOB of 12.5 kdaN and the top drive controller 206 is set to maintain a constant rotation rate of 90 RPM. The solid line of FIG. 6C shows measured ROP when the system 200 is applied with the initial set point for WOB at 5 kdaN and for RPM at 50. ROP on average is materially higher when the system 200 is applied compared to when constant RPM and WOB set points are used.

Figure 7A:
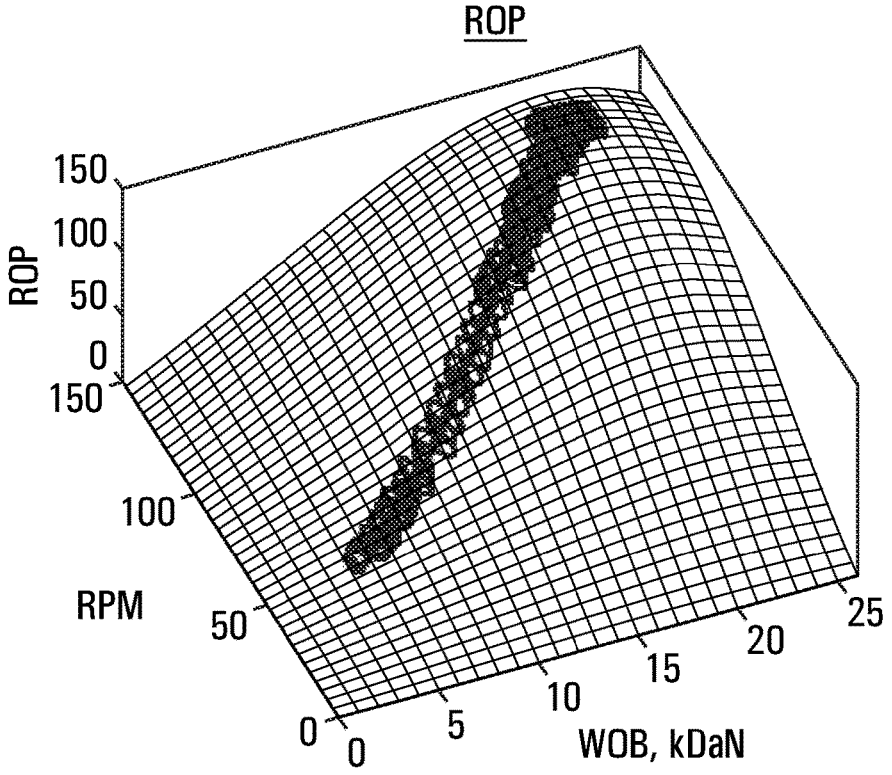
FIGS. 7A and 7B depict 3D plots of ROP and mechanical specific energy ("MSE"), respectively, versus RPM and WOB, according to the example embodiment of FIGS. 6A-C.
Figure 7B:
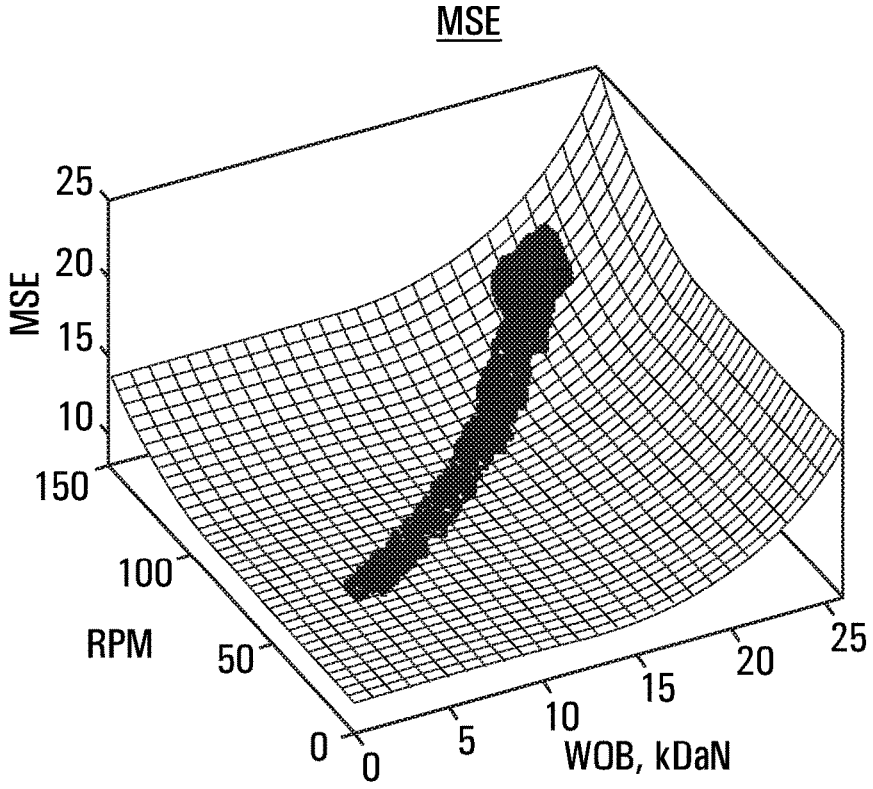

FIGS. 7A and 7B depict 3D plots of ROP and MSE, respectively, versus RPM and WOB, according to the example embodiment of FIGS. 6A-C. ROP and MSE are shown in relative units. The ROP and MSE values followed by the system 200 until convergence are shown.

Example 2

Figure 8A:
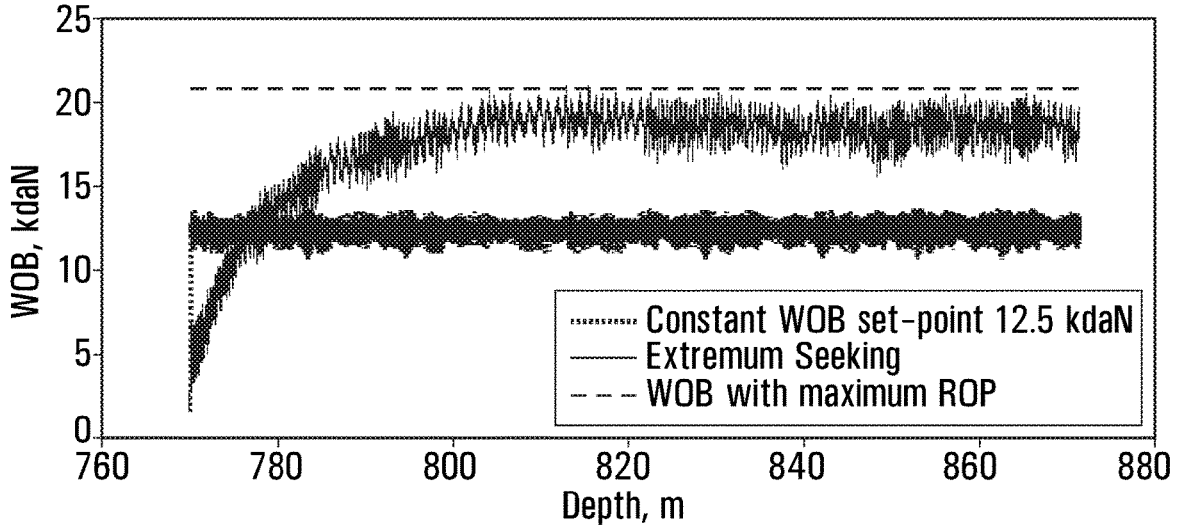
FIGS. 8A, 8B, and 8C depict 2D plots of WOB, RPM, and ROP, respectively, versus drilling depth, according to another example embodiment.
Figure 8B:
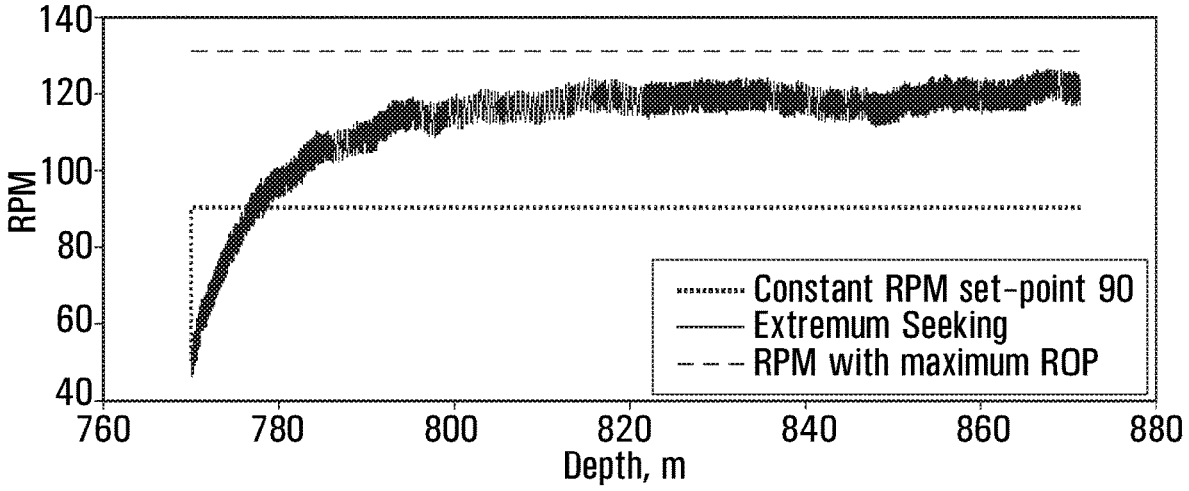
Figure 8C:
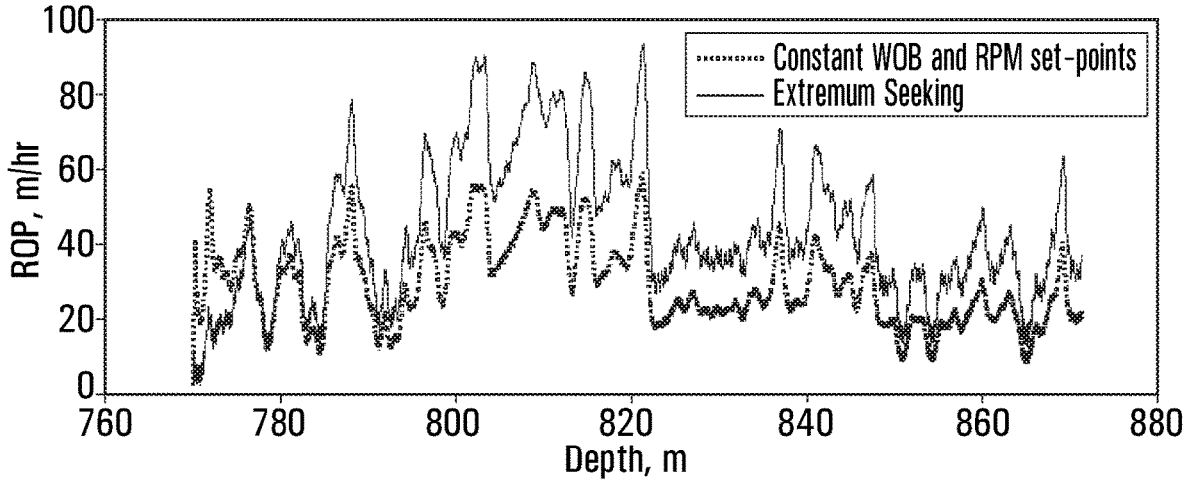

Referring now to FIGS. 8A, 8B, and 8C, there are depicted 2D plots of WOB, RPM, and ROP, respectively, versus drilling depth, according to one example embodiment in which the output of the objective functions 304,404 is set equal to $(ROP^2)/(T^{0.8}\ RPM^{0.8})$, where T is torque applied by the top drive 110.

The long dashed line in FIG. 8A represents the theoretical actual WOB which, combined with the theoretical actual RPM, permits determination of the theoretical maximum ROP. The short dashed line in FIG. 8A represents measured WOB when the automated drilling unit 208 is set to maintain a constant WOB of 12.5 kdaN. The solid line in FIG. 8A represents measured WOB when applying the system 200 with the initial set point for WOB at 5 kdaN and for RPM at 50. The plot of FIG. 8A shows measured WOB when the system 200 is applied converging to the WOB corresponding to maximum objective function value.

The long dashed line in FIG. 8B represents theoretical actual RPM at maximum ROP. The short dashed line in FIG. 8B represents measured RPM when the top drive controller 206 is set to maintain a constant rotation rate of 90 RPM. The solid line in FIG. 8B represents measured RPM when applying the system 200 with the initial set point for WOB at 5 kdaN and for RPM at 50. The plot of FIG. 8B shows measured RPM when the system 200 is applied converging to the RPM corresponding to maximum objective function value.

The dashed line in FIG. 8C shows measured ROP when the automated drilling unit 208 is set to maintain a constant WOB of 12.5 kdaN and the top drive controller 206 is set to maintain a constant rotation rate of 90 RPM. The solid line of FIG. 8C shows measured ROP when the system 200 is applied with the initial set point for WOB at 5 kdaN and for RPM at 50. ROP on average is materially higher when the system 200 is applied compared to when constant RPM and WOB set points are used.

Figure 9A:
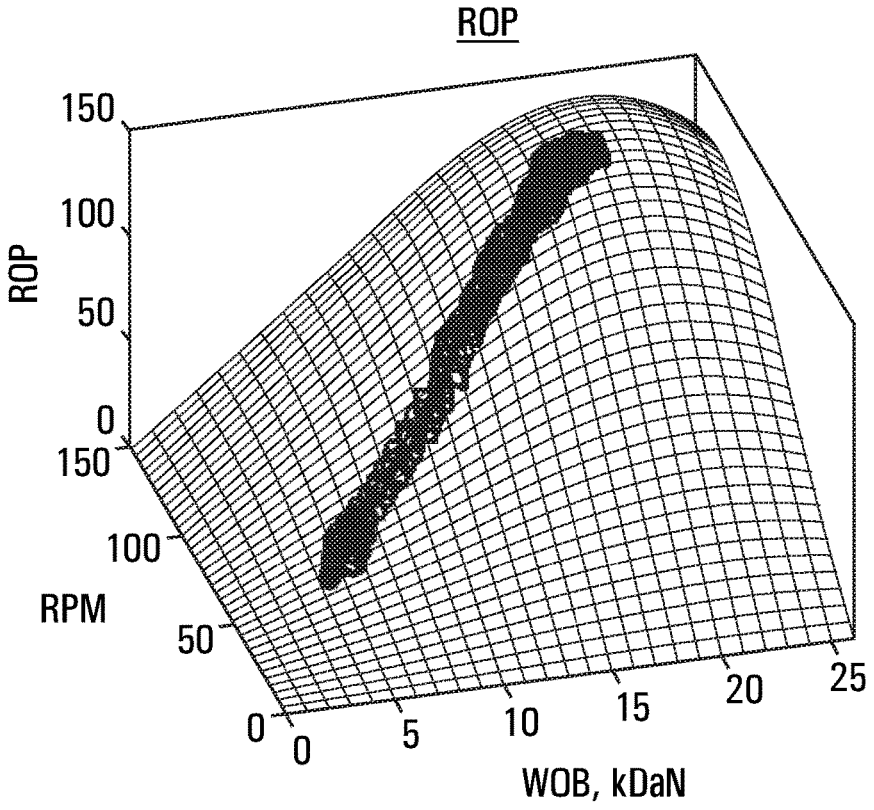
FIGS. 9A and 9B depict 3D plots of ROP and MSE, respectively, versus RPM and WOB, according to the example embodiment of FIGS. 8A-C.
Figure 9B:
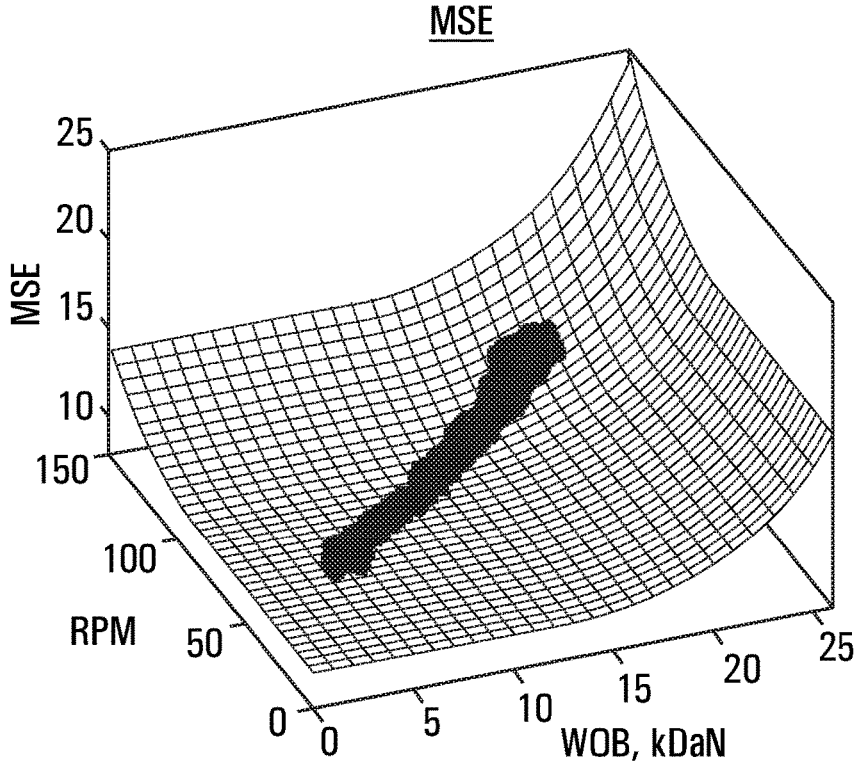

FIGS. 9A and 9B depict 3D plots of ROP and MSE, respectively, versus RPM and WOB, according to the example embodiment of FIGS. 8A-C. ROP and MSE are shown in relative units. The ROP and MSE values followed by the system 200 until convergence to the maximum of the objective function of Equation (1.1), with a=b=0.8 and c=2.

While particular embodiments have been described in the foregoing, it is to be understood that other embodiments are possible and are intended to be included herein. It will be clear to any person skilled in the art that modifications of and adjustments to the foregoing embodiments, not shown, are possible.

For example, while in the depicted embodiments each of the WOB and rotation rate perturbation signals are sinusoidal (e.g., sine and cosine signals), in different embodiments (not depicted), they need not be. Example alternative types of perturbation signals comprise square or triangular waves. Similarly, while in the depicted embodiments the rotation rate perturbation signal has a frequency twice that of the WOB perturbation signal, in different embodiments (not depicted) the frequencies of the perturbation signals may be different. For example, in one different embodiment (not depicted) the WOB and rotation rate perturbation signals may be identical, in which case the processor 212 alternates between the use of WOB and rotation rate as the means of achieving the extremum of the specified objective function. In certain embodiments, the WOB perturbation signal has a frequency lower than that of the rotation rate perturbation signal, which reflects the relatively high responsiveness of rotation rate control in response to signals from the top drive PLC 110*b* when compared to the responsiveness of WOB in response to signals from the drawworks PLC 114*a*.

As another example, while in the depicted embodiment two drilling parameters (WOB and rotation rate) are used as inputs to the plants 302,402, in different embodiments more than two drilling parameters may be used as inputs, with each drilling parameter having its own perturbation signal. In certain embodiments the perturbation signal for each drilling parameter has a frequency different than the other drilling parameters. Furthermore, in certain embodiments one or more drilling parameters may be subject to an estimation and adjustment for delay, or other dynamic behavior, specific to those parameters; for example, when differential pressure is the drilling parameter in question, a lag correction factor may be applied.

In at least some different embodiments (not depicted), more than two signals may be dithered. Each additional signal may be dithered using a dither frequency specific to that signal.

As another example, while the drilling rig 100 in the depicted embodiments is capable of performing directional drilling by virtue of the bent sub 130 and mud motor 132, in different embodiments (not depicted) the drilling rig 100 may lack one or both of the bent sub 130 and motor 132.

As another example, in the depicted embodiments the drawworks 114 is used to raise and lower the drill string 118. In different embodiments (not depicted), a different height control apparatus for raising or lowering the drill string 118 may be used. For example, hydraulics may be used for raising and lowering the drill string 118. In embodiments in which hydraulics are used, the traveling block 108 may be omitted and consequently the processor 212 does not use the height of the block 108 as a proxy for drill string height, as it does in the depicted embodiments. In those embodiments, the processor 212 may use output from a different type of height sensor to determine drill string position and ROP. For example, the motion of the traveling block 108 may be translated into rotary motion and rotary motion encoder may then be used to digitize readings of that motion. This may be done using a roller that runs along a rail or, if crown sheaves are present, the encoder may be installed on the sheaves' axel. Various gears may also be present as desired. As additional examples, laser based motion measurements may be taken, a machine vision based measurement system may be used, or both.

As another example, in different embodiments (not depicted), other objective functions than those described above may be used. For example, in one of these embodiments the objective function may consider any one or more of mud flow rate, which affects rotation of the mud motor 132; torque applied to the drill string 118, which may be measured using a sensor on the top drive 110; standpipe pressure as determined using the standpipe pressure sensor 202*d*, which may be used to determine mud motor differential pressure and consequently downhole torque in embodiments in which the mud motor 132 is active; and a parameter that represents whether energy is being used efficiently, such as mechanical specific energy. In another non-depicted example embodiment, the objective function may comprise a target setpoint (e.g., target depth of cut, where depth of cut=ROP/RPM), and the processor 212 may attempt to adjust drilling so that the target setpoint is approached or achieved.

While a single processor 212 is depicted in FIG. 2, in different embodiments (not depicted) the processor 212 may comprise multiple processors, one or more microprocessors, or a combination thereof. Similarly, in different embodiments (not depicted) the single memory 214 may comprise multiple memories. Any one or more of those memories may comprise, for example, mass memory storage, ROM, RAM, hard disk drives, optical disk drives (including CD and DVD drives), magnetic disk drives, magnetic tape drives (including LTO, DLT, DAT and DCC), flash drives, removable memory chips such as EPROM or PROM, or similar storage media as known in the art.

In different embodiments (not depicted), the computer 210 may also comprise other components for allowing computer programs or other instructions to be loaded. Those components may comprise, for example, a communications interface that allows software and data to be transferred between the computer 210 and external systems and networks. Examples of the communications interface comprise a modem, a network interface such as an Ethernet card, a wireless communication interface, or a serial or parallel communications port. Software and data transferred via the communications interface are in the form of signals which can be electronic, acoustic, electromagnetic, optical, or other signals capable of being received by the communications interface. The computer 210 may comprise multiple interfaces.

In certain embodiments (not depicted), input to and output from the computer 210 is administered by an input/output (I/O) interface. In these embodiments the computer 210 may further comprise a display and input devices in the form, for example, of a keyboard and mouse. The I/O interface administers control of the display, keyboard, and mouse. In certain additional embodiments (not depicted), the computer 210 also comprises a graphical processing unit. The graphical processing unit may also be used for computational purposes as an adjunct to, or instead of, the processor 210.

In all embodiments, the various components of the computer 210 may be communicatively coupled to one another either directly or indirectly by shared coupling to one or more suitable buses.

Turning to FIGS. 11-23, and in accordance with embodiments of the disclosure, there will now be described systems and methods for performing automated drilling of a wellbore by detecting and managing drilling through formations with interbedded layers of rock with significantly different properties, referred to as stringers. In particular, the systems and methods are configured to detect stringers and, as a function of the type of stringer that is being entered or is being exited, adjust one or more drilling parameter targets in order to more efficiently drill through the stringers.

Figure 11:
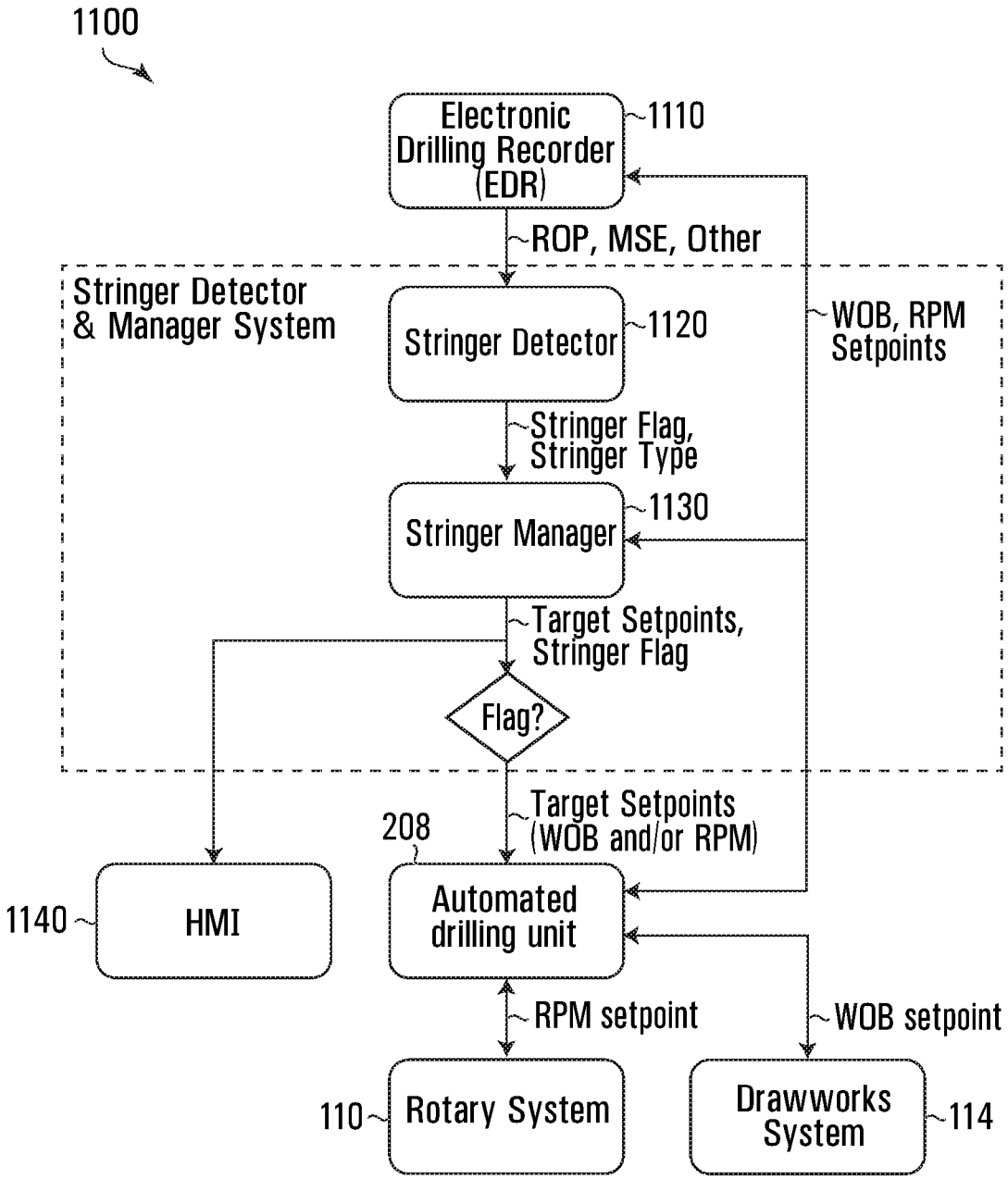
FIGS. 11 and 12 depict systems for performing automated drilling of a wellbore by detecting and managing drilling through stringers, according to embodiments of the disclosure.

FIG. 11 shows a block diagram of system 1100 for performing automated drilling of a wellbore by detecting and managing drilling through stringers. System 1100 includes an electronic drilling recorder (EDR) 1110 configured to record drilling parameters read during drilling. In particular, EDR 1110 is configured to record readings obtained from rig sensors 202 (FIG. 2). The sensor readings (which may be referred to as drilling parameters) include RPM, WOB, differential pressure, torque, and mechanical specific energy (MSE) which may be derived from other drilling parameters. The drilling parameter readings are sent from EDR 1110 to a stringer detector 1120 configured to detect when the drill bit enters or exits a stringer. Stringer detector 1120 is further configured to identify the type of stringer (soft or hard) that has been entered/exited. Stringer detector 1120 is communicative with a stringer manager 1130 configured to update one or more drilling parameter targets (hereinafter "drilling parameter targets") as a function of the output of stringer detector 1120. The drilling parameter targets that are updated include RPM and WOB, although in some embodiments other drilling parameter targets may also be updated.

The updated drilling parameter targets are output by stringer manager 1130 and received at Human Machine Interface (HMI) 1140. HMI 1140 displays the updated drilling parameter targets to an operator who may choose to act upon them, e.g. by inputting them to automated drilling unit 208 as described below. In addition, the updated drilling parameter targets may be output by stringer manager 1130 and received directly at automated drilling unit 208. In response to receiving the updated drilling parameter targets, automated drilling unit 208 controls rotary system 110 as a function of the updated RPM target, and automated drilling unit 208 controls drawworks system 114 as a function of the updated WOB target. Automated drilling unit 208 may comprise UJB 1 204*a* and UJB 2 204*b* shown in FIG. 2, rotary system 110 may be top drive 110 shown in FIG. 2, and drawworks system 114 may be drawworks 114 shown in FIG. 2.

Figure 12:
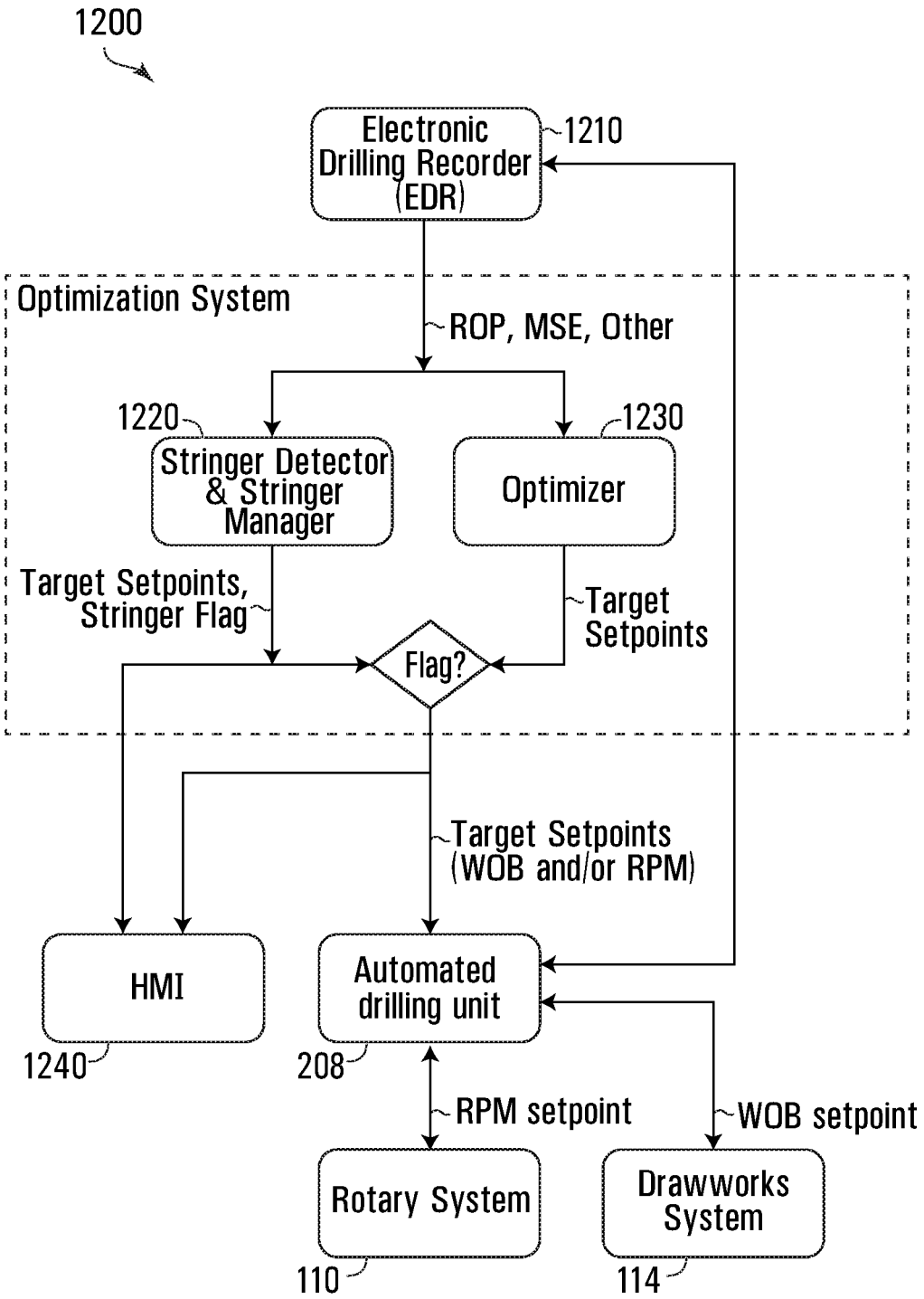

Turning to FIG. 12, there is shown another embodiment of a system 1200 for performing automated drilling of a wellbore by detecting and managing drilling through stringers. System 1200 is similar to system 1100, except that system 1200 includes an optimizer 1230 configured to receive the drilling parameter readings from EDR 1210. As will be described below in more detail, optimizer 1230 is also configured to output updated drilling parameter targets directly to automated drilling unit 208.

Systems 1100 and 1200 are configured to operate in different modes, as set out below.

Alert only: In this mode, stringer detector 1120 only communicates with HMI 1140 (i.e. communication with stringer manager 1130 is not required) and alerts, via HMI 1140, the operator of any detected stringers and their type.

Advisory: In this mode, stringer manager 1130 communicates recommended updated drilling parameter targets to the operator via HMI 1140. The operator may choose (or not) to act upon them.

Top drive control only: In this mode, stringer manager 1130 communicates a recommended WOB target to HMI 1140 for display to the operator. In addition, stringer manager 1130 outputs an updated RPM target to automated drilling unit 208 which in a closed-loop process controls rotary system 110 according to the updated RPM target.

Drawworks control only: In this mode, stringer manager 1130 communicates a recommended RPM target to HMI 1140 for display to the operator. In addition, stringer manager 1130 outputs an updated WOB target to automated drilling unit 208 which in a closed-loop process controls drawworks system 114 according to the updated WOB target.

Top Drive and Drawworks control: In this mode, stringer manager 1130 outputs updated RPM and WOB targets to automated drilling unit 208 which in a closed-loop process controls rotary system 110 according to the updated RPM target and controls drawworks system 114 according to the updated WOB target.

There will now be described a method of performing automated drilling of a wellbore, by detecting and managing drilling through stringers. The method is first described in the context of system 1100, and subsequently in the context of system 1200.

Figure 13:
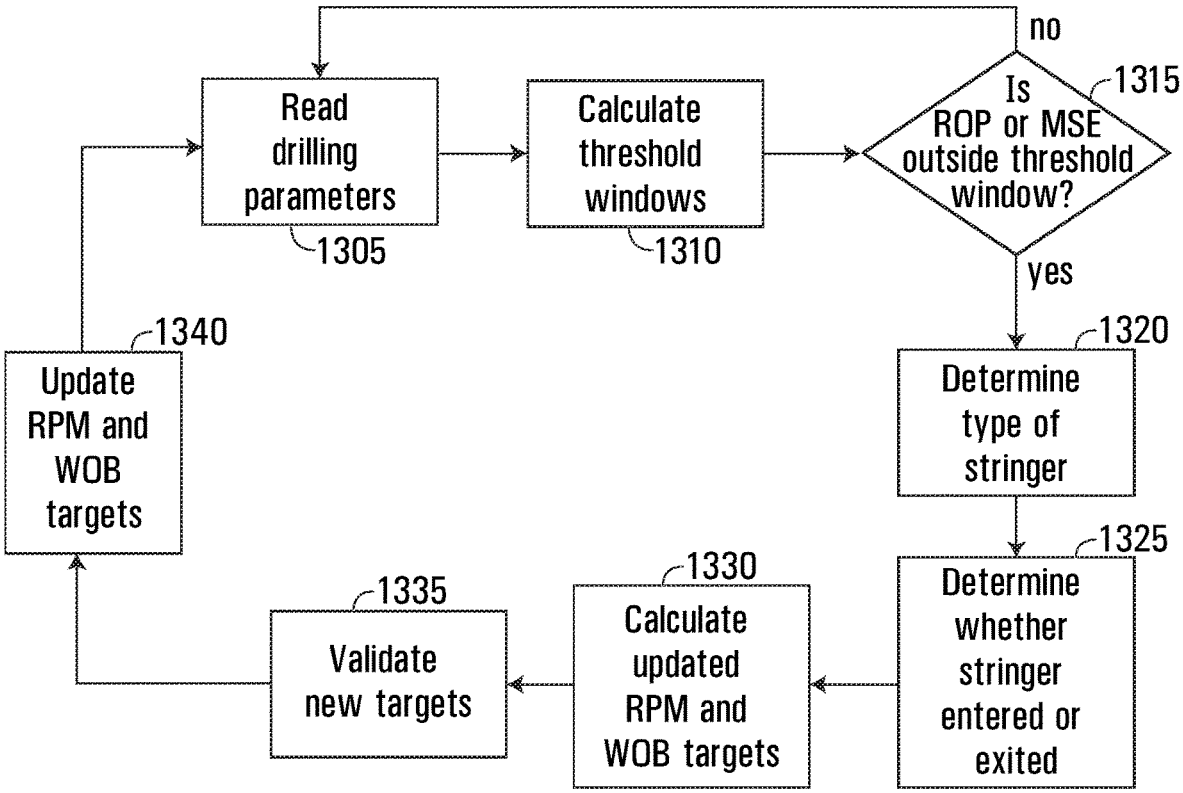
FIG. 13 depicts a method for performing automated drilling of a wellbore by detecting and managing drilling through stringers, according to an embodiment of the disclosure.

Turning to FIG. 13, at block 1305, stringer detector 1120 receives ROP and MSE readings obtained by EDR 1110. MSE is calculated from surface measurements of one or more of WOB, RPM, rotary torque, differential pressure, mud flow rate, and physical/technical specifications of the drill bit/mud motor (e.g. bit diameter, mud motor speed to flow ratio, maximum mud motor torque, and maximum differential pressure). In one embodiment, MSE is determined according to $(480*Tor*RPM)/(Dia^2*ROP)+(4*WOB)/(Dia^2*\pi)$, wherein Tor is torque (in ft-lbs), Dia is bit diameter (in inches), ROP is ROP in feet per hour, and WOB is WOB in lbs force. In some embodiments, other drilling parameter readings may be received at stringer detector 1120. At block 1310, stringer detector 1120 processes the ROP and MSE readings to calculate a threshold window for each of the ROP and the MSE drilling parameters. The threshold windows are calculated by determining moving averages of the ROP and MSE readings, and by calculating lower and upper bounds to the averages, as now described below.

Let $x_t$ denote the input signal sequence of the input drilling parameter ROP or MSE at time t>0. Let $\hat{x}_t$ denote its filtered value. Filtering is used to smooth the input signal. Without loss of generality, an example of a filtered value of the sequence $x_t$ is given by averaging the signal with its previous measurements over a sliding window. The moving average of x at time t≥k is given by:

$$\hat{x}_t = \sum_{k=0}^{N-1} w_k x_{t-k} \text{ with } \sum_{k=0}^{N-1} w_k = 1$$

where N is an integer and is the length of the moving average window, and $w_k$ is comprised in [0,1] and is the weight associated with $x_t$. If all measurements are weighted equally, the moving average of x at time t is given by:

$$\hat{x}_t = \frac{1}{N}\sum_{k=0}^{N-1} x_{t-k}$$

The values $\hat{x}_t$ form another sequence calculated at each time instance t. Typical parameters used in practice are $w_k$=1/N, with window sizes of N=120 seconds and N=60 seconds. The lower and upper bounds of $x_t$ at time t are given by:

$$x_{L,t}=\hat{x}_t-\max(\beta_L\hat{x}_t,C_L),x_{U,t}=\hat{x}_t+\max(\beta_U\hat{x}_t,C_U)$$

where $C_L$ and $C_U$ denote the minimum fixed lower and upper bounds in the units of the input drilling parameter, respectively. These are used to ensure a minimum change criterion is met. The values $\beta_L$ and $\beta_U$ define the dynamic lower and dynamic upper bounds with dimensionless values of β comprised in [0,1). The lower and upper bounds $x_{L,t}$ and $x_{U,t}$ are calculated at each time instance t. Each of the parameters in the set P={$C_L$, $C_U$, $\beta_L$, $\beta_U$} may be configurable by the user. Typical values used in practice when ROP is used as the input are P={25 m/hr, 25 m/hr, 0.3, 0.3}.

At block 1315, stringer detector 1120 determines if either of ROP and MSE is outside its respective threshold window. If neither ROP nor MSE is outside its respective threshold window, then the process repeats by looping back to block 1305. If ROP is determined to have exceeded the upper bound of its threshold window, then, at block 1320, stringer detector 1120 determines that the drilling has encountered a soft stringer (a layer of relatively soft rock). If ROP is determined to have dropped beneath the lower bound of its threshold window, then stringer detector 1120 determines that the drilling has encountered a hard stringer (a layer of relatively hard rock). Conversely, stringer detector 1120 determines that the drilling has encountered a soft stringer if MSE is determined to have dropped beneath the lower bound of its threshold window, and stringer detector 1120 determines that the drilling has encountered a hard stringer if MSE is determined to have exceeded the upper bound of its threshold window.

In addition to determining the type of stringer, at block 1325, stringer detector 1120 determines whether or not the stringer has been entered or else has been exited. Stringers are effectively anomalies in an otherwise constant formation of "normal" or intermediary rock, i.e. rock that is neither unusually soft nor unusually hard given typical drilling conditions. Therefore, when exiting a stringer, drilling of intermediary rock resumes. Accordingly, stringer detector 1120 will determine that a stringer is being exited if it had previously detected the entry of the stringer, and, vice versa, stringer detector 1120 will determine that a stringer is being entered if it had previously detected the exit of a stringer. The output of stringer detector 1120 (whether a stringer is entered or is exited, and the type of stringer entered or exited) is sent to stringer manager 1130.

Stringer detector 1120 is further configured to classify a formation of rock as either a hard stringer or a soft stringer based on the relative change in ROP or MSE. Thus, if currently drilling through a hard stringer, a sudden increase in ROP would cause stringer detector 1120 to detect entry of a soft stringer even though in reality the drill bit will in all likelihood have exited the hard stringer and entered intermediary rock. However, stringers are typically much shallower in depth than layers intermediary rock. Therefore, stringer detector 1120 is configured to automatically recalibrate after a certain depth of rock (which may be user-configurable) has been penetrated without any sudden, sharp changes in ROP or MSE. Upon recalibration, stringer detector 1120 is configured to output neither an indication of a hard stringer nor a soft stringer. It is therefore assumed that, after drilling through the preset depth of rock (for example 30 metres) and/or for a preset period of time (for example 30 minutes), any soft or hard stringer that was previously being drilled through has been exited and the drilling is currently proceeding through intermediary rock.

At block 1330, stringer manager 1130 determines from stringer detector 1120's output updated RPM and WOB targets. In practice, the updated RPM and WOB targets are set as a percentage of the current RPM and WOB targets. In one embodiment, targetStringerRpmSetpoint=currentRpmSetpoint*(1−beta) where beta=0.3 and targetStringerWobSetpoint=currentWobSetpoint*(1+alpha) where alpha=0.1.

Alpha and beta are constants that are user-configurable and generally determined empirically. In some embodiments, in the case of the RPM target, the RPM target may be adjusted in an effort to maintain a desired or target depth of cut (DOC), wherein DOC=ROP/RPM.

At block 1335, the updated RPM and WOB targets are validated against one or more safety conditions. In particular, the updated RPM and WOB targets must be achievable and within the bounds of any preset limits or constraints. Furthermore, any updated RPM and WOB target must be determined not to cause other related drilling parameters (such as torque and differential pressure) to be outside any of their respective preset limits or constraints.

Assuming that the updated RPM and WOB targets are validated, the updated RPM and WOB targets are passed to automated drilling unit 208 which, at block 1340, are used to control rotary system 110 and drawworks 114 (assuming that system 1100 is operating in Top Drive and Drawworks control mode). In some embodiments, the current RPM and WOB targets are adjusted in a gradual, ramped manner so as to approach the updated RPM and WOB targets, respectively. In particular, targetSetpoint=currentSetpoint+gain (targetSetpoint−currentSetpoint), wherein gain is a user-configurable constant, targetSetpoint is the updated RPM or WOB target, and current Setpoint is the current RPM or WOB target. The updated RPM and WOB targets are also displayed to the operator via HMI 1140. The process then returns to block 1305. In some embodiments, only one of the RPM and WOB targets may be updated. In other embodiments, one or more other drilling parameter targets may also be updated.

Once the measured RPM and WOB parameters are determined to be sufficiently close to the updated RPM and WOB targets, control of the RPM and WOB targets is passed to optimizer 1230, as now described in further detail below.

In the case of system 1200, in the absence of stringers, control of the drilling parameter targets is governed by optimizer 1230. In particular, optimizer 1230 is configured to implement any of the functionality described above in connection with method 500 and FIG. 5, in order to control the drilling parameter targets.

Figure 14:
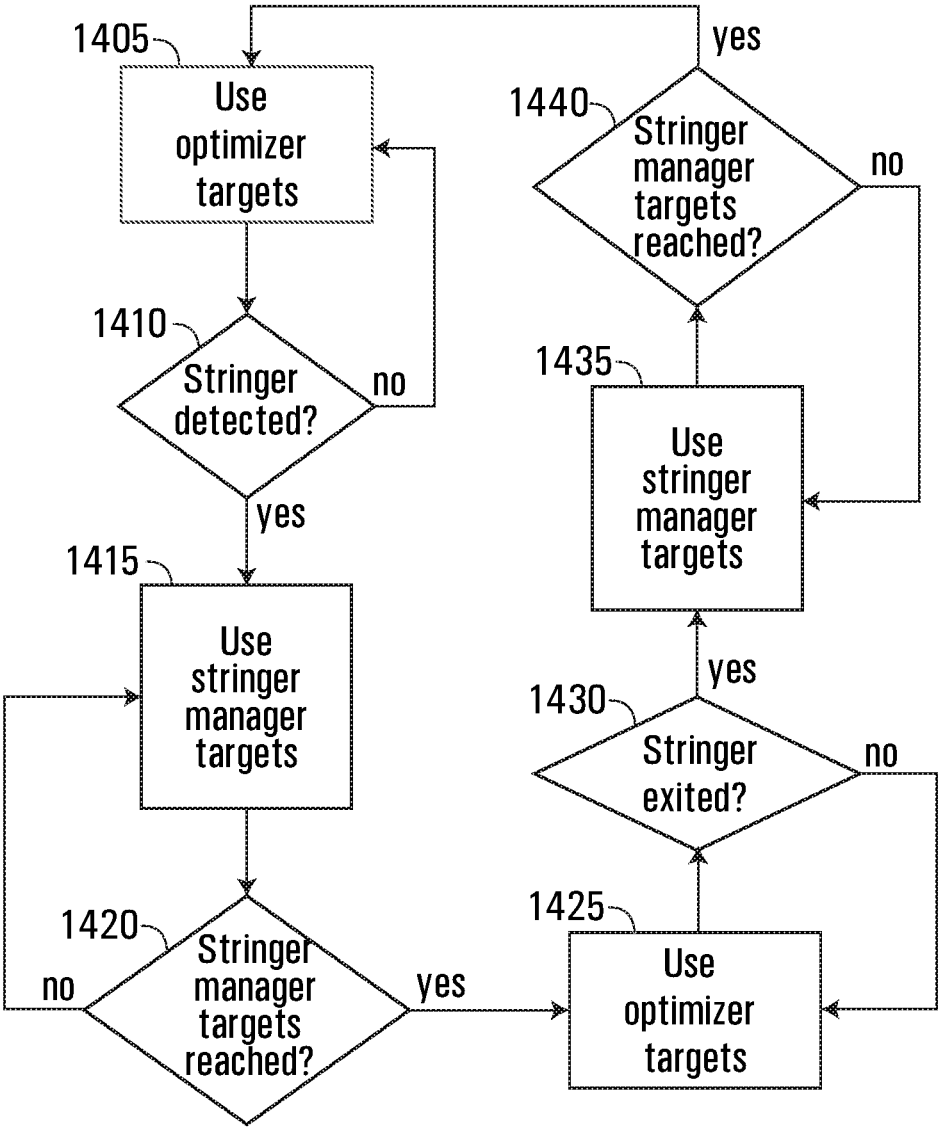
FIG. 14 depicts a method of updating drilling parameter targets by transitioning between use of a stringer detector and manager, and an optimizer, in accordance with an embodiment of the disclosure.

As can be seen in FIG. 14, optimizer 1230 initially controls the drilling parameter targets (block 1405). When a stringer is flagged by stringer detector 1220 (block 1410), the drilling parameter targets produced by optimizer 1230 are temporarily overridden (block 1415) by the drilling parameter targets calculated by stringer manager 1220 (block 1330 in FIG. 13). Once the measured RPM and WOB parameters are within respective preset thresholds of their respective updated RPM and WOB targets (block 1420), control of the drilling parameter targets reverts to optimizer 1230 (block 1425). When the end of the stringer is flagged by stringer detector 1220 (block 1430), the drilling parameter targets calculated by optimizer 1230 are again temporarily overridden (block 1435) by the drilling parameter targets calculated by stringer manager 1220. Once the measured RPM and WOB parameters are within respective preset thresholds of their respective updated RPM and WOB targets (block 1440), control of the drilling parameter targets reverts to optimizer 1230 (block 1405).

Figure 15:
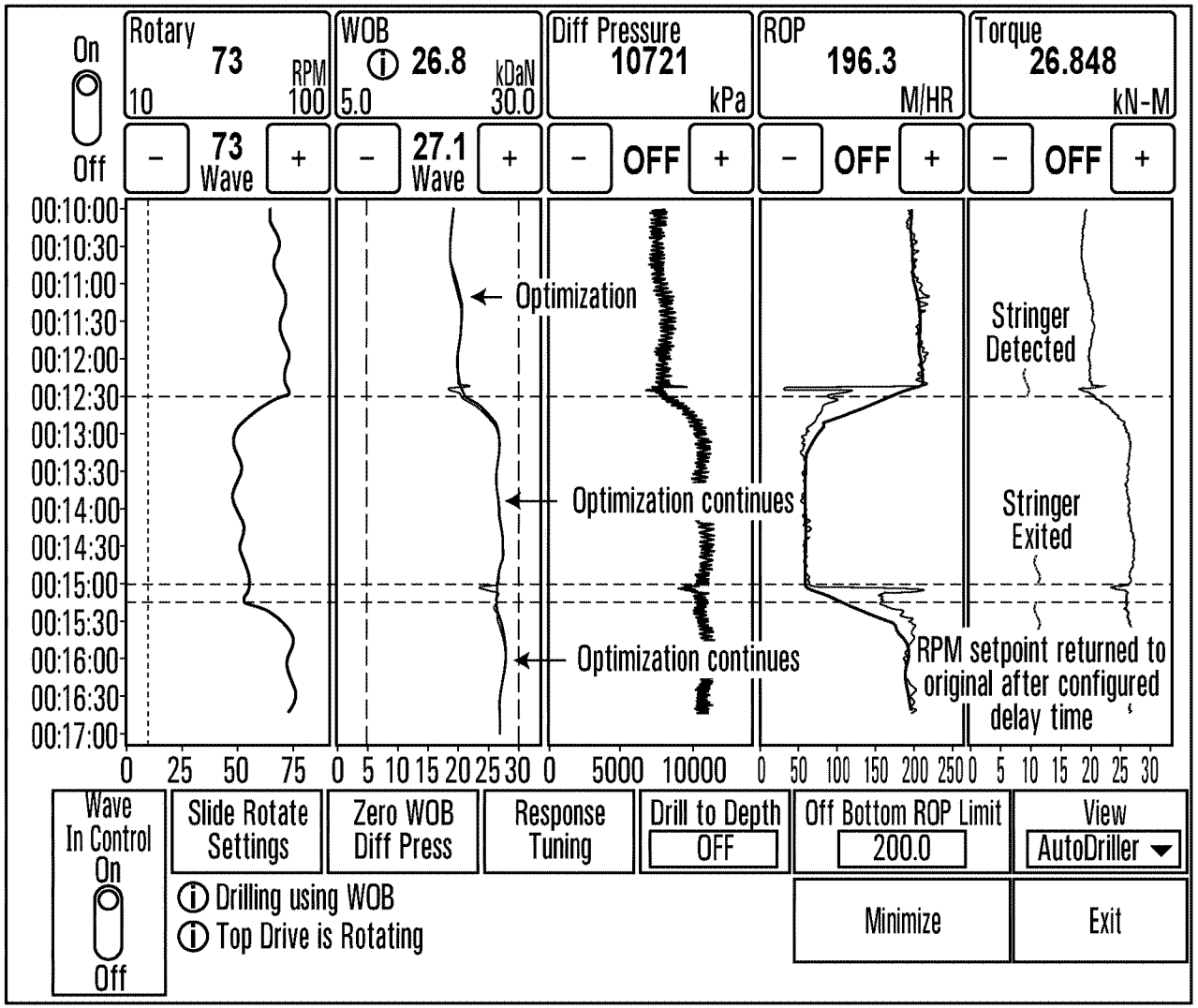
FIGS. 15 and 16 are plots of drilling parameter targets before a stringer is entered, once the stringer has been entered, and after the stringer has been exited.
Figure 16:
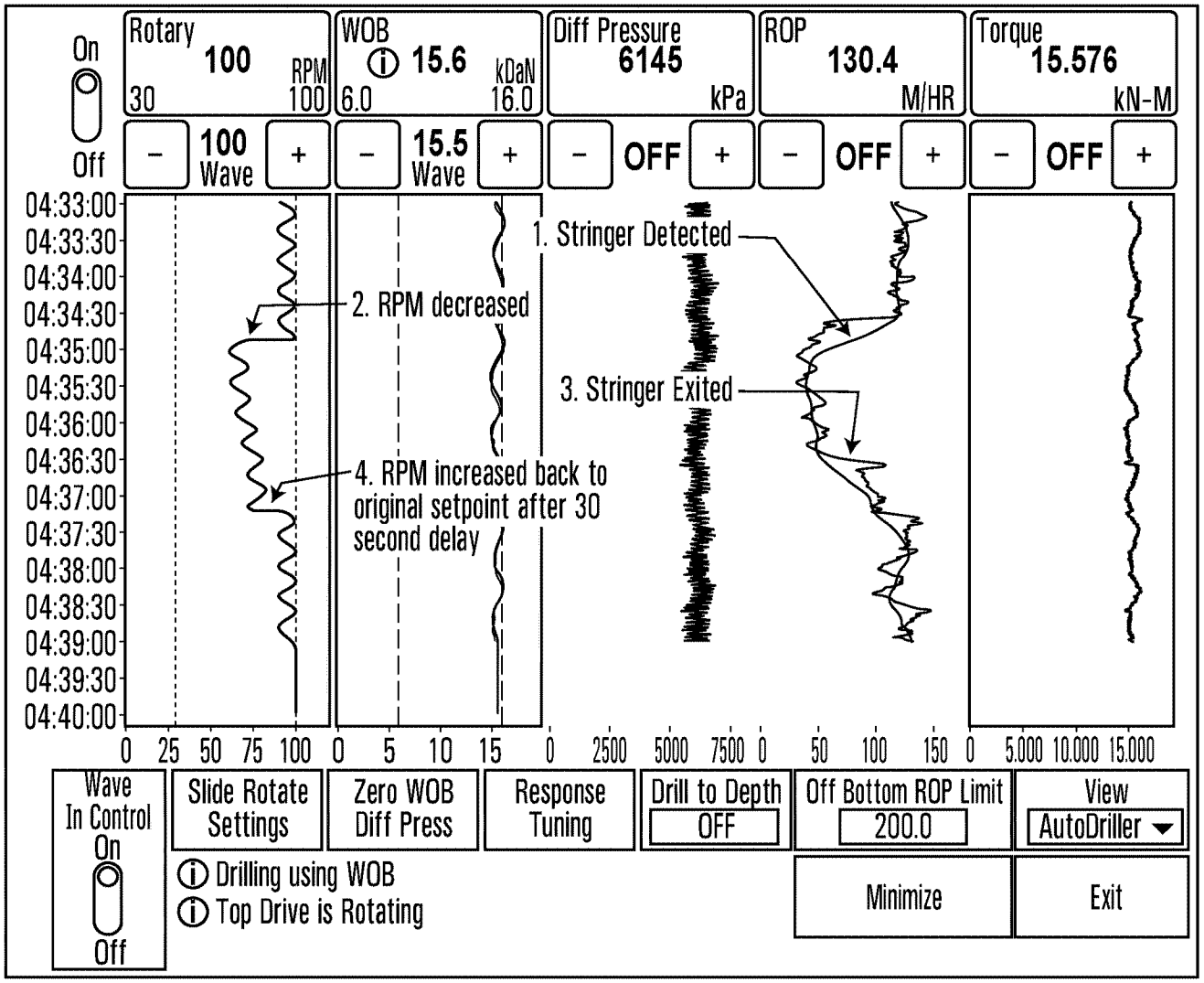

FIGS. 15 and 16 show examples of the RPM and WOB targets being adjusted as a function of whether or not the drill bit is currently transecting a stringer. As can be seen, upon entry to and exit from a stringer, the RPM and WOB targets undergo sharp changes (controlled by stringer manager 1220) before control reverts to optimizer 1230.

In an alternative embodiment, instead of the RPM and WOB targets being adjusted by a preset amount in response to a stringer being detected, stringer manager 1130 may be configured to determine updated RPM and WOB targets based on historical, stored RPM and WOB targets. In particular, depending on the type of stringer that is entered, a specific subset of historical RPM and WOB targets may be used to determine the updated RPM and WOB targets.

During transection of a hard stringer, the RPM and WOB targets that are generated are substantially different to RPM and WOB targets generated when drilling through soft or intermediary rock. Therefore, when determining the updated RPM and WOB targets in response to entering a hard stringer, stringer manager 1130 should only consider past RPM and WOB targets that were generated when drilling through hard stringers. Similarly, during transection of a soft stringer, the RPM and WOB targets that are generated are substantially different to RPM and WOB targets generated when drilling through hard or intermediary rock. Therefore, when determining the updated RPM and WOB targets in response to entering a soft stringer, stringer manager 1130 should only consider past RPM and WOB targets that were generated when drilling through soft stringers. And lastly, during transection of intermediary rock, the RPM and WOB targets that are generated are substantially different to RPM and WOB targets generated when drilling through soft or hard stringers. Therefore, when determining the updated RPM and WOB targets in response to entering intermediary rock, stringer manager 1130 should only consider past RPM and WOB targets that were generated when drilling through intermediary rock.

When a new RPM or WOB target is generated by stringer manager 1130, its associated ROP value is categorized as a function of the type of formation (hard stringer, soft stringer, or intermediary rock) through which drilling is proceeding. By extension, the new RPM or WOB target is also categorized as a function of the type of formation through which drilling is proceeding. Stringer manager 1130 therefore maintains a finite time-series list of past ROP values and associated RPM targets and WOB targets categorized as a function of the type of formation through which drilling is proceeding. When the list is full, the oldest RPM or WOB target is removed to make room for the next RPM or WOB target. When stringer detector 1220 detects entry of a new formation, stringer manager 1130 may determine updated RPM and WOB targets using, as described above, only those past RPM and WOB targets in the stored list that share the same category as the type of formation that has just been entered. Those RPM and WOB targets that do not share the same category as the type of formation that has just been entered are excluded from stringer manager 1130's calculations. For example, if stringer detector 1220 detects entry of a soft stringer, then only those RPM and WOB targets in the stored list that have been categorized as being associated with a soft stringer are used by stringer manager 1130 when updating the RPM and WOB targets. Stringer manager 1130 may update the RPM and WOB targets using various suitable methods. For example, in some embodiments, stringer manager 1130 may determine an average of the filtered, past RPM and WOB targets stored in the list, and use this average to determine the updated RPM and WOB targets.

This method of categorizing drilling parameter targets as a function of the formation type through which drilling proceeded when the target was generated, and then only using filtered past drilling parameter targets to determine future drilling parameter targets, may be applied more generally to other methods of performing automated drilling. For example, this method may be combined with the extremum-based optimization method described above (FIG. 5), or with iterative MSE-based approaches for optimizing drilling through automated updating of drilling parameter targets.

Figure 17:
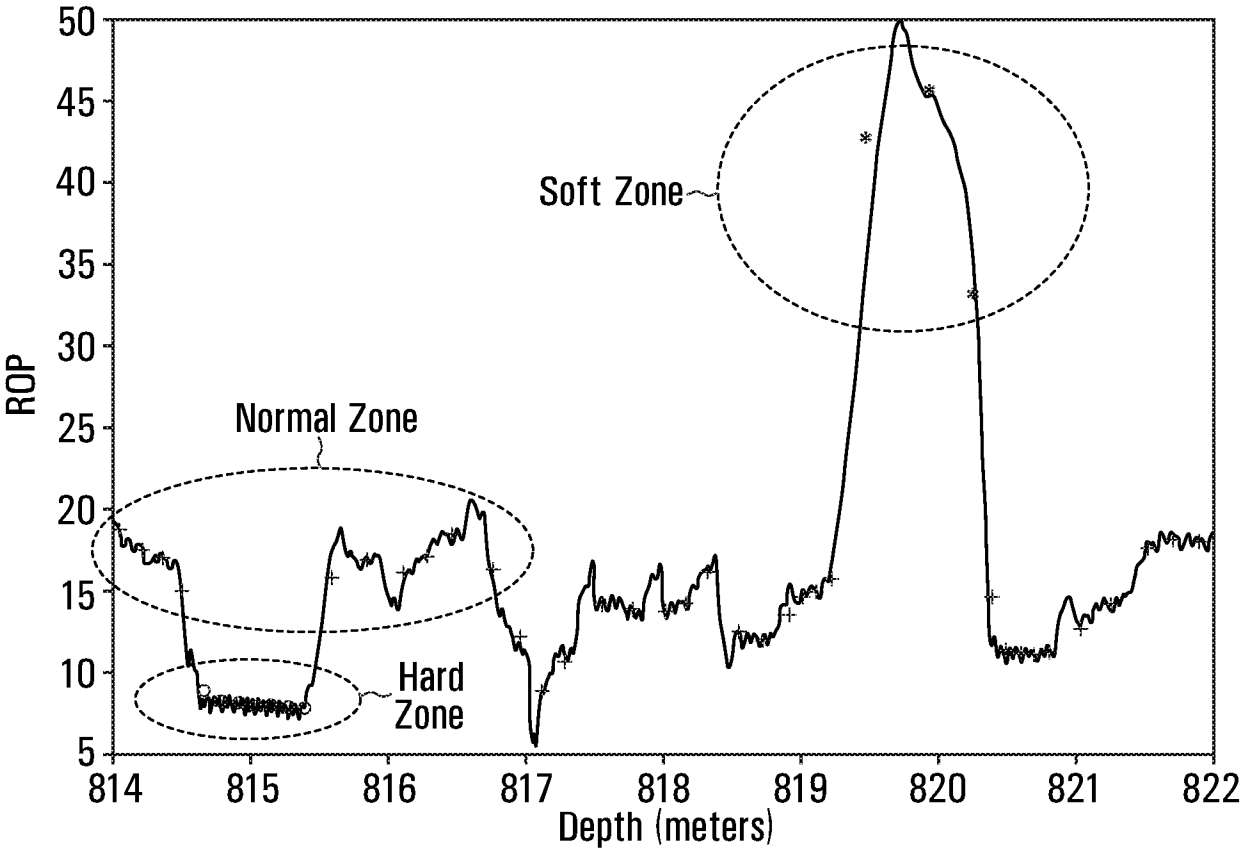
FIG. 17 depicts ROP readings categorized as a function of whether they were determined in connection with a soft stringer, a hard stringer, or intermediary rock

FIG. 17 shows an example of the categorization of ROP readings. Each ROP reading is associated with corresponding RPM and WOB targets generated in response to the ROP reading being obtained, a depth at which the ROP reading was obtained, and a time at which the ROP reading was obtained. In the plot of FIG. 17, ROP readings shown as circles represent ROP readings obtained when transecting a hard stringer, ROP readings shown as asterisks represent ROP readings obtained when transecting a soft stringer, and ROP readings shown as crosses represent ROP readings obtained when transecting intermediary rock (rock that is neither part of a hard nor a soft stringer).

Figure 18A:
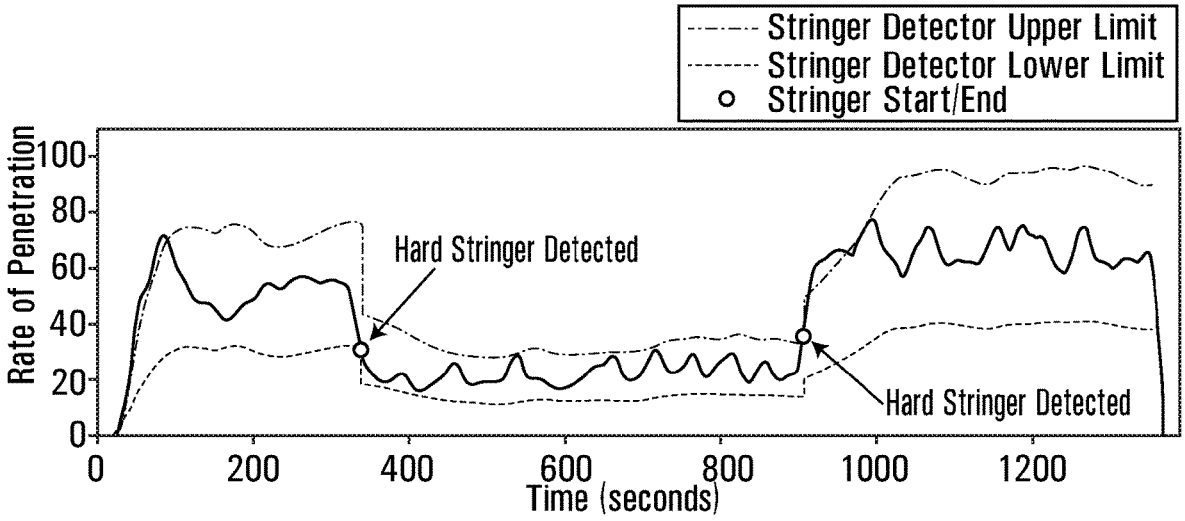
FIGS. 18A-C depict plots of ROP, WOB and RPM before a stringer is entered, once the stringer has been entered, and after the stringer has been exited.
Figure 18B:
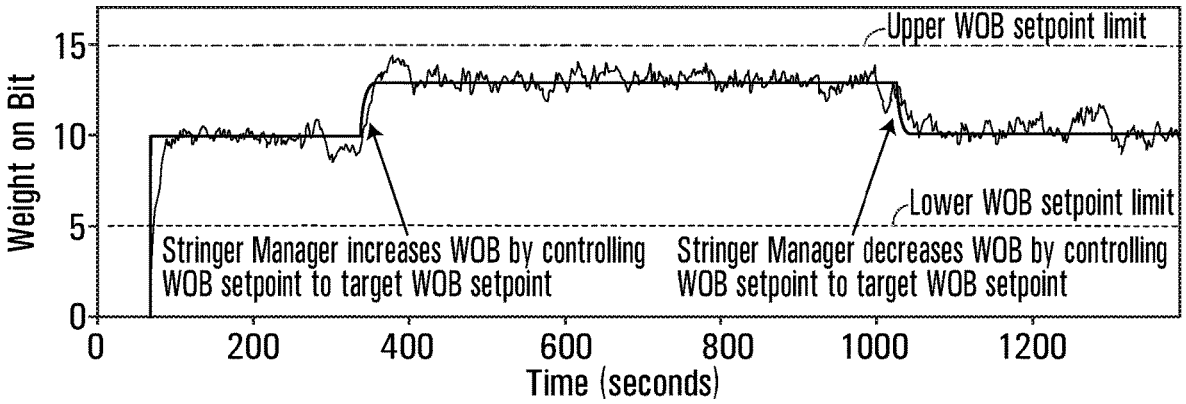
Figure 18C:
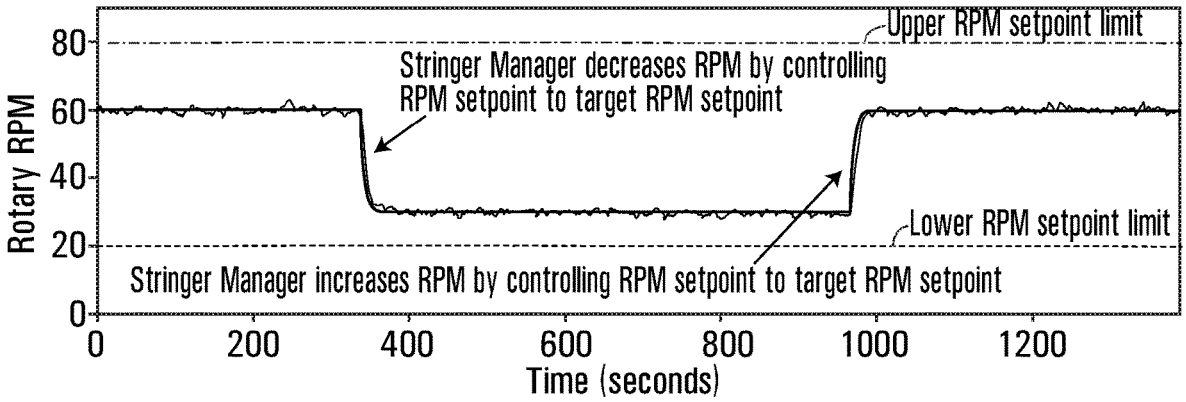

FIG. 18 shows measured ROP, WOB and RPM in response to entering and exiting a hard stringer. As can be seen, ROP drops suddenly as the hard stringer is entered, and increases suddenly upon exiting the hard stringer. In order to drill more efficiently through the stringer, and in order to protect the drill bit, stringer manager 1220 increases the WOB target in response to detecting entry of a hard stringer, and may decrease the WOB target in response to detecting that the hard stringer has been exited (typically by allowing WOB to reduce naturally through decompression of the drill string in response to the drawworks slowing the rate of penetration). Increasing WOB promotes better indentation into the rock and reduces "skidding/grinding" of the rotating drill bit. Similarly, stringer manager 1220 decreases the RPM target in response to detecting that a hard stringer has been entered, and increases the RPM target in response to detecting that the hard stringer has been exited.

In FIG. 18, the following parameters are used. Averaging window=120 seconds, $C_L$ and $C_U$=30, $beta_L$ and $beta_U$=0.4; Stringer Manager Parameters: RPM target beta=0.5, WOB target alpha=0.3, RPM gain=0.2, WOB gain=0.2, RPM return delay=60 seconds, WOB return delay=120 seconds.

Figure 19A:
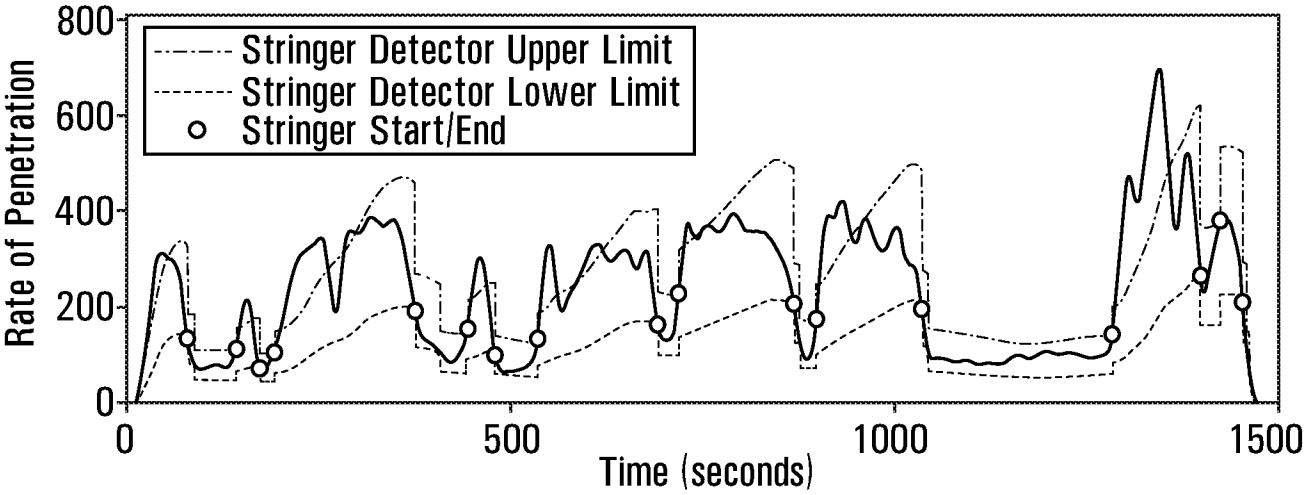
FIGS. 19A-B and FIGS. 20A-20B depict plots of ROP and RPM.
Figure 19B:
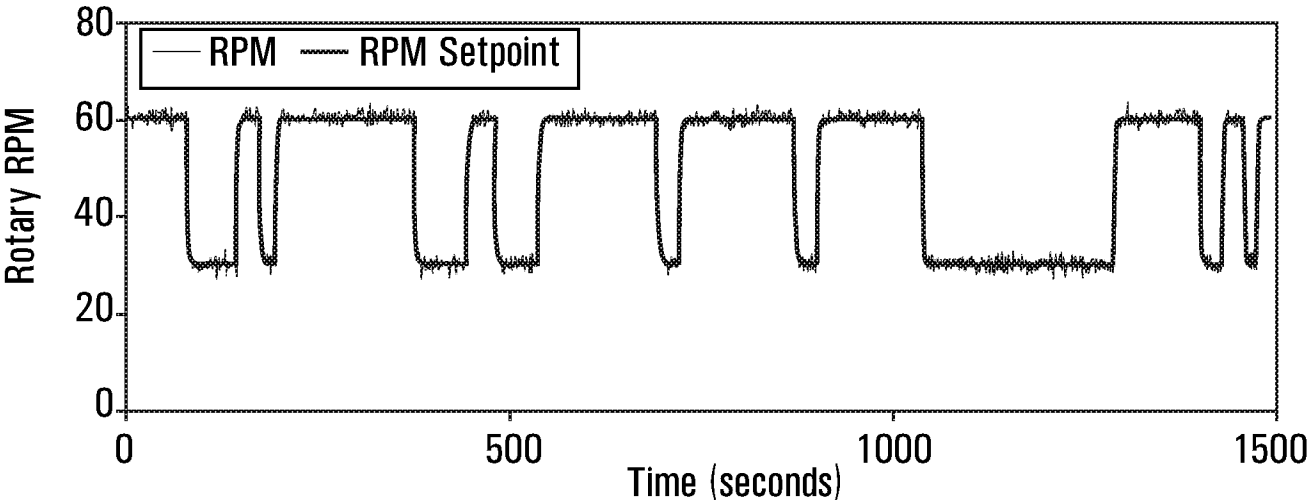
Figure 20A:
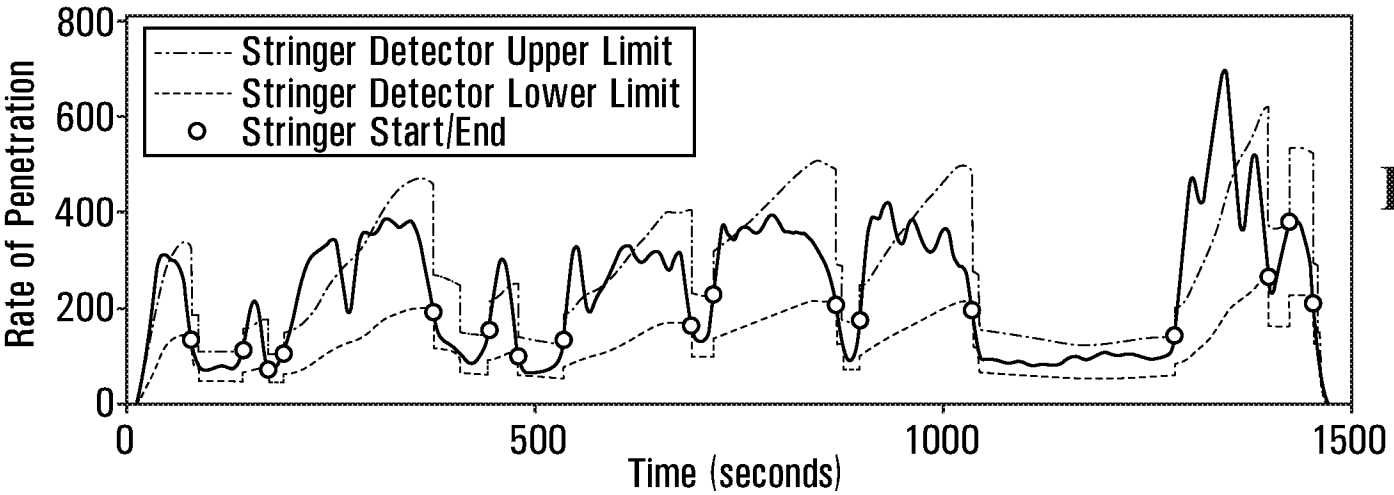
Figure 20B:
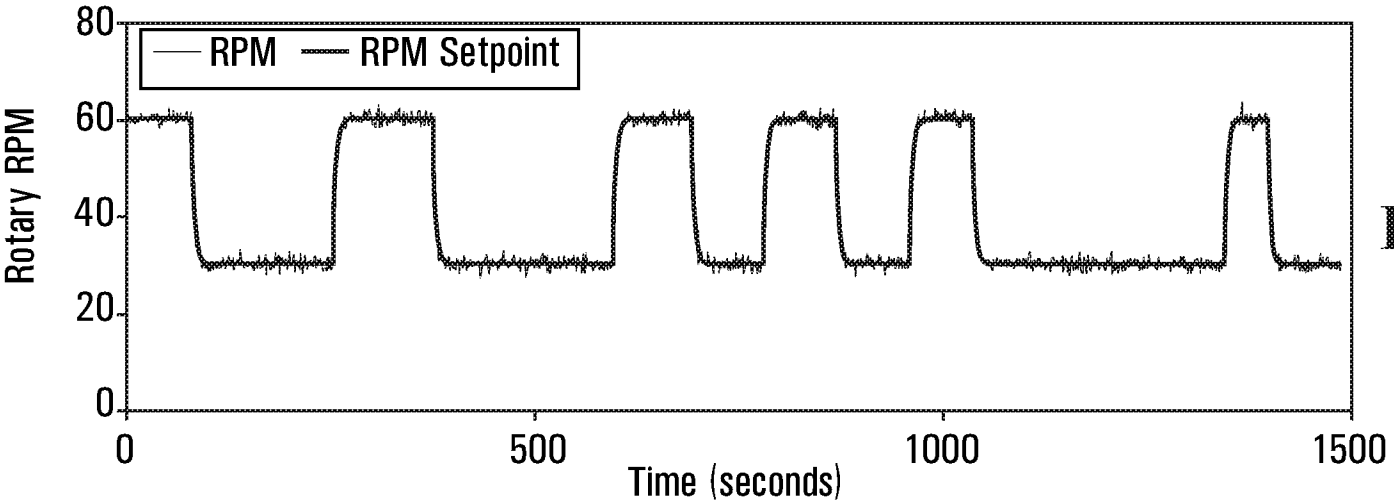

FIGS. 19 and 20 show plots of ROP as a function of time with the same set of parameters for stringer detector 1220 and different sets of parameters for stringer manager 1130. The threshold window for ROP, including its lower and upper limits, can be seen in both plots.

Stringers can occasionally occur in quick succession, with rapid, consecutive alternations between soft stringers and intermediary rock, intermediary rock and hard stringers, or even soft stringers and hard stringers. In such instances, upon detection that a stringer has been exited, it may be beneficial to introduce a user-configurable delay before reverting to the original RPM and WOB targets that were in force before entry of the stringer. The reason is that if another stringer of the same type follows in rapid succession, RPM and WOB would undergo another rapid change as their targets were again updated. Rapid changes in RPM can negatively affect equipment such as the top drive rotary system, and should therefore be eliminated if possible. Furthermore, rapid increases/decreases in WOB can lead to stick slip or whirl, causing premature wear on the bit cutter. For example, as can be seen in FIGS. 19 and 20, rapid successions of hard stringers can cause the RPM to undergo rapid fluctuations which may cause damage to the downhole equipment such as the drill bit, bottom hole assembly, as well as surface equipment including the rotary system and drawworks system. By introducing a user-configurable delay (for example, 60 seconds in FIG. 20 compared to 0 seconds in FIG. 19) before reverting the RPM (and WOB) targets to their pre-stringer values, RPM (as well as WOB) may reduce the number of RPM responses in the case of multiple stringers located in quick succession, as can be seen in FIG. 19 compared to FIG. 20.

Figure 21A:
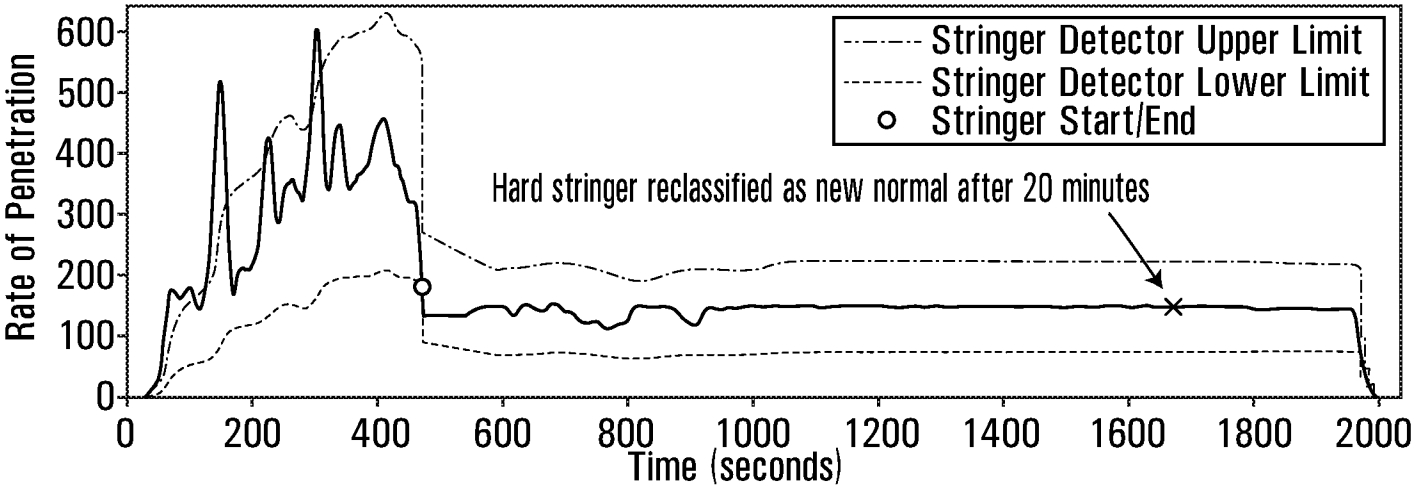
FIGS. 21A-B depict plots of ROP and RPM, including the re-classification of a hard stringer as intermediary rock.
Figure 21B:
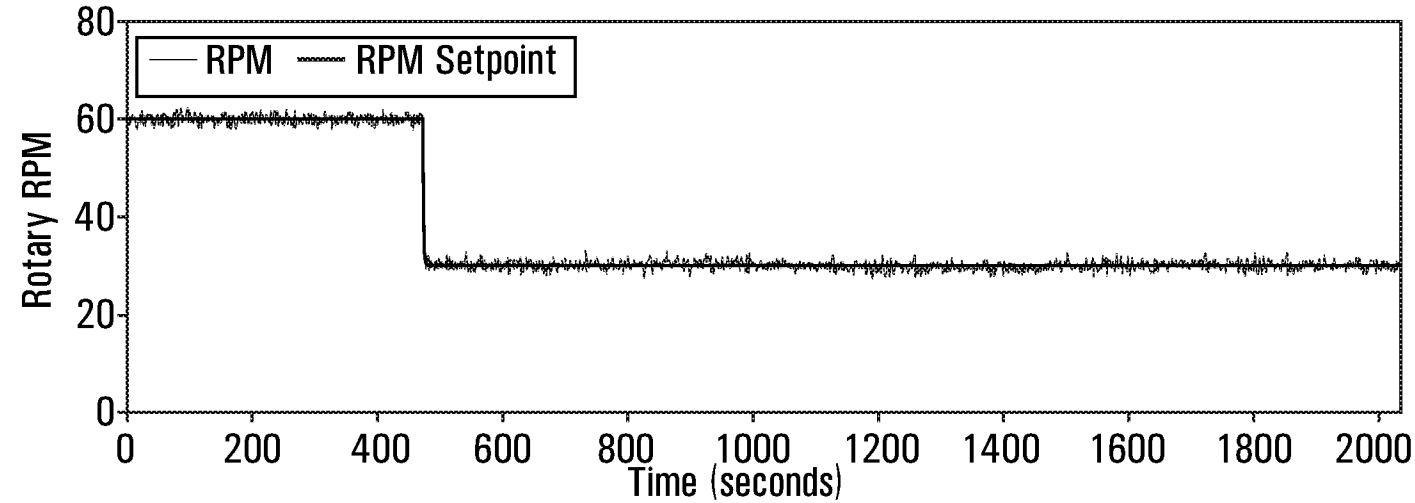

On the other hand, a hard/soft stringer may persist for an extended period of time/depth interval. In these cases, and as described above, once a hard/soft stringer has been identified and the RPM and WOB target updates are made, an additional user-configurable delay (for example 20 minutes) may be implemented before stringer manager 1130 re-classifies the current formation type as a normal formation type (neither a hard nor a soft stringer, i.e. intermediary rock). FIG. 21 shows the point in time at which, according to one embodiment, stringer manager 1130 re-classifies the current formation type as a normal formation type, given the persistent depth of in this case a hard stringer. Note that, in the embodiment of FIG. 21, stringer detector 1220 is configured to only detect relative transitions from intermediary rock to a hard stringer. Thus, stringer detector 1220 does not flag a stringer in response to ROP exceeding the upper limit of the threshold window. Of course, in other embodiments, stringer detector 1220 may be configured to detect both soft and hard stringers, as described above.

In FIG. 19, the following parameters are used. Averaging window=120 seconds, $C_L$, $C_U$=30, $beta_L$, $beta_U$=0.4; Stringer Manager Parameters: RPM target beta=0.5, RPM gain=0.5, RPM return delay=0 seconds.

In FIG. 20, the following parameters are used. Averaging window=120 seconds, $C_L$, $C_U$=30, $beta_L$, $beta_U$=0.4; Stringer Manager Parameters: RPM target beta=0.5, RPM gain=0.25, RPM return delay=60 seconds.

Directional terms such as "top", "bottom", "up", "down", "front", and "back" are used in this disclosure for the purpose of providing relative reference only, and are not intended to suggest any limitations on how any article is to be positioned during use, or to be mounted in an assembly or relative to an environment. The term "couple" and similar terms, and variants of them, as used in this disclosure are intended to include indirect and direct coupling unless otherwise indicated. For example, if a first component is communicatively coupled to a second component, those components may communicate directly with each other or indirectly via another component. Additionally, the singular forms "a", "an", and "the" as used in this disclosure are intended to include the plural forms as well, unless the context clearly indicates otherwise.

The word "approximately" as used in this description in conjunction with a number or metric means within 5% of that number or metric.

It is contemplated that any feature of any aspect or embodiment discussed in this specification can be implemented or combined with any feature of any other aspect or embodiment discussed in this specification, except where those features have been explicitly described as mutually exclusive alternatives.

The invention claimed is:

1. A method of performing automated drilling of a wellbore using a drill bit, comprising:

drilling the wellbore according to one or more drilling parameter targets associated with one or more corresponding drilling parameters;

using a drilling controller communicating with: a rotational drive unit controller; a rotation rate sensor; a height control apparatus; a height sensor; a depth sensor; and a hookload sensor, to:

determine, during the drilling of the wellbore, that the drill bit has entered or exited a stringer, comprising determining that a controlling drilling parameter of the one or more drilling parameters is outside a threshold window; and in response to determining that the drill bit has entered or exited the stringer, and during the drilling of the wellbore, update one or more controlled drilling parameter targets of the one or more drilling parameter targets, wherein updating the one or more controlled drilling parameter targets comprises updating at least one of a revolutions per minute (RPM) target and a weight-on-bit (WOB) target; and after updating the one or more controlled drilling parameter targets, further drilling the wellbore according to the updated one or more controlled drilling parameter targets.

2. The method of claim 1, further comprising:

further determining that the controlling drilling parameter is outside the threshold window; and in response thereto, further updating the one or more controlled drilling parameter targets.

3. The method of claim 2, wherein further updating the one or more controlled drilling parameter targets comprises further updating the one or more controlled drilling parameter targets a predetermined period of time after the further determining that the controlling drilling parameter is outside the threshold window.

4. The method of claim 1, wherein the one or more drilling parameter targets further comprise one or more of a differential pressure target, a torque target, and a mechanical specific energy (MSE) target.

5. The method of claim 1, wherein the controlling drilling parameter comprises at least one of ROP and MSE.

6. The method of claim 1, wherein the threshold window is continuously determined.

7. The method of claim 1, wherein the threshold window is determined using a moving average of the controlling drilling parameter.

8. The method of claim 4, wherein the MSE target is determined according to one or more of: WOB, RPM, torque, differential pressure, mud flow rate, bit diameter, mud motor speed to flow ratio, a maximum mud motor torque, and a maximum differential pressure.

9. The method of claim 1, wherein:

determining that the controlling drilling parameter is outside the threshold window comprises determining that ROP is less than a lower limit of the threshold window, or that MSE has exceeded an upper lower limit of the threshold window; and updating the one or more controlled drilling parameter targets comprises at least one of reducing the RPM target and increasing the WOB target.

10. The method of claim 1, wherein:

determining that the controlling drilling parameter is outside the threshold window comprises determining that ROP has exceeded an upper limit of the threshold window, or that MSE is less than a lower limit of the threshold window; and updating the one or more controlled drilling parameter targets comprises at least one of increasing the RPM target and decreasing the WOB target.

11. The method of claim 1, wherein updating the one or more controlled drilling parameter targets comprises:

determining the updated one or more controlled drilling parameter targets; and adjusting over a period of time the one or more controlled drilling parameter targets until the one or more controlled drilling parameter targets are within a predetermined range of the updated one or more controlled drilling parameter targets.

12. The method of claim 1, wherein updating the one or more controlled drilling parameter targets comprises adjusting the one or more controlled drilling parameter targets by a preset amount.

13. The method of claim 1, wherein updating the one or more controlled drilling parameter targets comprises adjusting the one or more controlled drilling parameter targets using one or more historical controlled drilling parameter targets.

14. The method of claim 13, wherein each historical controlled drilling parameter target is associated with a formation type, and wherein the method further comprises:

determining a type of formation through which drilling is proceeding; and prior to adjusting the one or more controlled drilling parameter targets, filtering the one or more historical controlled drilling parameter targets based on the type of formation through which drilling is proceeding and based on the respective formation type associated with each historical controlled drilling parameter target.

15. The method of claim 14, further comprising, after a predetermined period of time has elapsed since determining that the controlling drilling parameter is outside the threshold window, associating at least one historical controlled drilling parameter target with a normal formation.

16. The method of claim 1, wherein drilling the wellbore according to the one or more drilling parameter targets comprises:

drilling the well bore according to a first drilling parameter target, wherein the first drilling parameter target comprises a first drilling parameter offset modified by a first drilling parameter perturbation signal;

measuring a first drilling performance metric to determine a measured first drilling performance metric, wherein the first drilling performance metric is indicative of a response of the drilling to the first drilling parameter target;

determining an output of a first objective function using the measured first drilling performance metric;

determining a first correlation between the output of the first objective function and the first drilling parameter perturbation signal;

determining an integral of the first correlation;

updating the first drilling parameter target using the integral of the first correlation modified by the first drilling parameter perturbation signal; and after the first drilling parameter target has been updated, drilling the wellbore according to the first drilling parameter target.

17. The method of claim 16, wherein the drilling of the well bore according to the first drilling parameter target occurs in response to determining that one or more controlled drilling parameters are within a predetermined range of their corresponding one or more controlled drilling parameter targets.

18. The method of claim 1, wherein drilling the wellbore according to the updated one or more controlled drilling parameter targets comprises:

drilling the well bore according to a first drilling parameter target, wherein the first drilling parameter target comprises a first drilling parameter offset modified by a first drilling parameter perturbation signal;

measuring a first drilling performance metric to determine a measured first drilling performance metric, wherein the first drilling performance metric is indicative of a response of the drilling to the first drilling parameter target;

determining an output of a first objective function using the measured first drilling performance metric;

determining a first correlation between the output of the first objective function and the first drilling parameter perturbation signal;

determining an integral of the first correlation;

updating the first drilling parameter target using the integral of the first correlation modified by the first drilling parameter perturbation signal; and after the first drilling parameter target has been updated, drilling the wellbore according to the first drilling parameter target.

19. The method of claim 18, wherein the drilling of the well bore according to the first drilling parameter target occurs in response to determining that one or more controlled drilling parameters are within a predetermined range of their corresponding one or more controlled drilling parameter targets.

20. A system for performing automated drilling of a well bore, the system comprising:

a height control apparatus configured to adjust a height of a drill string comprising a drill bit used to drill the wellbore;

a height sensor;

a rotational drive unit comprising a rotational drive unit controller and a rotation rate sensor;

a depth sensor;

a hookload sensor;

a drilling controller communicatively coupled to the rotational drive unit controller, the rotation rate sensor, the height control apparatus, the height sensor, the depth sensor, and the hookload sensor, the drilling controller configured to perform a method comprising:

drilling the wellbore according to one or more drilling parameter targets associated with one or more corresponding drilling parameters;

determining, during the drilling of the wellbore, that the drill bit has entered or exited a stringer, comprising determining that a controlling drilling parameter of the one or more drilling parameters is outside a threshold window;

in response to determining that the drill bit has entered or exited the stringer, and during the drilling of the wellbore, updating one or more controlled drilling parameter targets of the one or more drilling parameter targets, wherein updating the one or more controlled drilling parameter targets comprises updating at least one of a revolutions per minute (RPM) target and a weight-on-bit (WOB) target; and after updating the one or more controlled drilling parameter targets, further drilling the wellbore according to the updated one or more controlled drilling parameter targets.

21. A non-transitory computer-readable medium having stored thereon program code executable by a processor and configured, when executed, to cause the processor to communicate with a rotational drive unit controller, a rotation rate sensor, a height control apparatus, a height sensor, a depth sensor and a hookload sensor to perform a method of performing automated drilling of a well bore using a drill bit, comprising:

drilling the wellbore according to one or more drilling parameter targets associated with one or more corresponding drilling parameters;

determining, during the drilling of the wellbore, that the drill bit has entered or exited a stringer, comprising determining that a controlling drilling parameter of the one or more drilling parameters is outside a threshold window;

in response to determining that the drill bit has entered or exited the stringer, and during the drilling of the wellbore, updating one or more controlled drilling parameter targets of the one or more drilling parameter targets, wherein updating the one or more controlled drilling parameter targets comprises updating at least one of a revolutions per minute (RPM) target and a weight-on-bit (WOB) target; and after updating the one or more controlled drilling parameter targets, further drilling the wellbore according to the updated one or more controlled drilling parameter targets.

* * * * *